US012484656B2

(12) United States Patent
Abel et al.

(10) Patent No.: US 12,484,656 B2
(45) Date of Patent: Dec. 2, 2025

(54) UPPER FOR A SHOE WITH A BALL CONTACT AREA

(71) Applicant: adidas AG, Herzogenaurach (DE)

(72) Inventors: Rohan Abel, Nuremberg (DE); Jose Munoz, Nuremberg (DE); Benjamin Alexander Thompsett, Nuremberg (DE); Rupert Malein, Nuremberg (DE); Andreas Hierl, Nuremberg (DE); Raphael Curet, Nuremberg (DE)

(73) Assignee: adidas AG, Herzogenaurach (DE)

( * ) Notice: Subject to any disclaimer, the term of this patent is extended or adjusted under 35 U.S.C. 154(b) by 0 days.

(21) Appl. No.: 18/758,383

(22) Filed: Jun. 28, 2024

(65) Prior Publication Data

US 2025/0000201 A1 Jan. 2, 2025

(30) Foreign Application Priority Data

Jun. 29, 2023 (DE) ..... 10 2023 206 175.9

(51) Int. Cl.
*A43B 5/02* (2006.01)
*A43B 7/1425* (2022.01)
*A43B 13/04* (2006.01)

(52) U.S. Cl.
CPC ..... *A43B 7/1425* (2013.01); *A43B 13/04* (2013.01); *A43B 5/025* (2013.01)

(58) Field of Classification Search
CPC ..... A43B 5/025
USPC ..... 36/133
See application file for complete search history.

(56) References Cited

U.S. PATENT DOCUMENTS

| | | | |
|---|---|---|---|
| 3,191,321 | A | 6/1965 | Bruetting |
| 5,437,112 | A | 8/1995 | Johnston |
| 5,555,650 | A | 9/1996 | Longbottom et al. |
| 6,523,282 | B1 | 2/2003 | Johnston |
| 7,487,605 | B2 | 2/2009 | Hatzilias |
| 8,789,298 | B2 | 7/2014 | Eder et al. |
| 9,038,288 | B2 | 5/2015 | Droege et al. |
| 9,693,694 | B2 | 7/2017 | Halaka |

(Continued)

FOREIGN PATENT DOCUMENTS

| | | | |
|---|---|---|---|
| CN | 206390385 | U | 8/2017 |
| CN | 207269957 | U | 4/2018 |

(Continued)

OTHER PUBLICATIONS

25 Years Old—Full Adidas Predator History—1994-2020 https://web.archive.org/web/20201001004051/https://www.footyheadlines.com/2017/05/here-is-the-complete-history-of-the-adidas-predator.html.

*Primary Examiner* — Marie D Bays
(74) *Attorney, Agent, or Firm* — Sterne, Kessler, Goldstein Fox P.L.L.C.

(57) ABSTRACT

An upper for a shoe, in particular a sports shoe, comprising a ball contact area comprising a plurality of protrusions. Each protrusion of the plurality of protrusions has an elongated shape with a longitudinal axis, a sole facing side portion and an instep facing side portion. Each protrusion of the plurality of protrusions is elastically bendable such that each protrusion is configured to bend substantially in a perpendicular direction to the longitudinal axis upon contact with a ball, and such that each of the plurality of protrusions is configured to bend such that the instep facing side portion touches an outer surface of the upper or an adjacent protrusion of the plurality of protrusions.

22 Claims, 9 Drawing Sheets

(56) References Cited

U.S. PATENT DOCUMENTS

| | | | | |
|---|---|---|---|---|
| 2003/0167658 | A1 | 9/2003 | Davis | |
| 2004/0055183 | A1* | 3/2004 | Lee | A43B 23/025 36/133 |
| 2006/0218821 | A1* | 10/2006 | Hatzilias | A43B 5/025 36/133 |
| 2010/0077637 | A1* | 4/2010 | Hatzilias | A43B 3/0042 36/133 |
| 2010/0331122 | A1 | 12/2010 | Morag | |
| 2011/0035963 | A1 | 2/2011 | Baker et al. | |
| 2011/0247240 | A1 | 10/2011 | Eder et al. | |
| 2011/0258883 | A1 | 10/2011 | Eder et al. | |
| 2012/0233888 | A1 | 9/2012 | Baker et al. | |
| 2013/0074374 | A1* | 3/2013 | Droege | A43B 7/24 36/133 |
| 2013/0125417 | A1* | 5/2013 | Minami | A43B 5/025 36/83 |
| 2015/0128453 | A1 | 5/2015 | Oroszi et al. | |
| 2015/0201705 | A1 | 7/2015 | Doremus et al. | |
| 2015/0342300 | A1 | 12/2015 | Cin et al. | |
| 2016/0143395 | A1 | 5/2016 | Van Atta et al. | |
| 2016/0270478 | A1 | 9/2016 | Doremus et al. | |
| 2016/0331065 | A1 | 11/2016 | Lam | |
| 2017/0071291 | A1 | 3/2017 | Follet et al. | |
| 2018/0184760 | A1 | 7/2018 | Doremus et al. | |
| 2020/0022450 | A1* | 1/2020 | Baines | A43B 5/02 |
| 2021/0085018 | A1 | 3/2021 | Chen et al. | |
| 2021/0204640 | A1 | 7/2021 | Oroszi et al. | |
| 2021/0345725 | A1 | 11/2021 | Arana et al. | |

FOREIGN PATENT DOCUMENTS

| | | | |
|---|---|---|---|
| DE | 202010017958 | U1 | 6/2013 |
| EP | 1430801 | A1 | 6/2004 |
| EP | 2659798 | A1 | 11/2013 |
| EP | 3053467 | A1 | 8/2016 |
| EP | 2891422 | B1 | 11/2019 |
| EP | 3909459 | A1 | 11/2021 |
| JP | S5986103 | U | 6/1984 |
| JP | 2016185380 | A | 10/2016 |
| WO | WO-2007144331 | A1 | 12/2007 |
| WO | WO-2010055276 | A1 | 5/2010 |
| WO | WO-2010086672 | A1 | 8/2010 |
| WO | WO-2012125333 | A2 | 9/2012 |
| WO | WO-2017025111 | A1 | 2/2017 |
| WO | WO-2019220157 | A1 | 11/2019 |

* cited by examiner

UPPER FOR A SHOE WITH A BALL CONTACT AREA

CROSS REFERENCE TO RELATED APPLICATIONS

This application claims priority to German Patent Application No. 10 2023 206 175.9, filed Jun. 29, 2023, which is incorporated by reference herein in its entirety.

TECHNICAL FIELD

The present disclosure relates to an upper for a shoe, such as a sports shoe. The upper comprises a ball contact area configured to assist with shooting a ball. The present disclosure also relates to a shoe, such as a sports shoe, comprising such an upper attached to a sole.

BACKGROUND

A shoe or generally an article of footwear is commonly described as the combination of an upper and a sole structure. Typically, the upper covers regions such as the instep, the toe, the medial side, the lateral side, and the heel of a wearer's foot and provides an opening to allow the wearer to step inside the footwear. The sole is connected to the upper such that its top side faces the foot, and its bottom side touches the ground during ordinary use of the shoe.

The upper for a shoe generally provides a number of functionalities. The upper provides an enclosure for receiving the foot, stabilizes the foot during movements, protect the foot against the environment, and, in case of certain sport shoes, provides a surface specifically adapted to the needs of the athlete.

Particularly uppers for shoes used in athletic activities such as soccer, rugby, football and other ball sports are widely used and are popular among wearers.

BRIEF SUMMARY

It is an object of the present disclosure to provide an improved upper for a shoe. The upper provides for improved means to assist with shooting. In particular, more advanced and/or dedicated spin is provided to the ball, particularly for striking shots. Furthermore, an objective is to provide a respective shoe comprising such an upper.

The present disclosure includes an upper for a shoe, such as a sports shoe, comprising: a) a ball contact area comprising a plurality of protrusions; b) wherein each protrusion of the plurality of protrusions has an elongated shape with a longitudinal axis, a sole facing side portion and an instep facing side portion; and c) wherein the ball contact area is configured to assist with shooting a ball in that each protrusion of the plurality of protrusions is elastically bendable such that each protrusion is configured to bend substantially in a perpendicular direction to the longitudinal axis upon contact with the ball, and such that each of the plurality of protrusions is configured to bend such that the instep facing side portion touches an outer surface of the upper or an adjacent protrusion of the plurality of protrusions.

In this manner, the upper facilitates improved assistance with shooting a ball, for example a soccer ball. In particular, the ball contact area provides enhanced means for contacting the ball, which ensures that sufficient grip is available. In addition a smoother transition for shooting, such as shooting a ball, is provided. Attributable to the elastically bendable protrusions, a brushing effect may be established. Such brushing effect generally means that a plurality of brushes (e.g., protrusions) can contact the ball and affect the travel path of the ball after leaving the upper. Further, the elastically bendable protrusions have the additional benefit that the contact time of the ball on the upper can be increased. This can be advantageous compared to prior art uppers having rigid protrusions that do not allow for the elastically bending described herein, and consequently fail to provide the advantages mentioned herein.

Moreover, the bending of the protrusions has the advantage that the surface area of the upper that can contact a ball is increased. This can facilitate improved shooting. The amount of bending may depend on the striking force. For instance, bending may increase with increase of the striking force.

To further highlight the advances of the present disclosure, an analysis of the travel trajectory of a ball along the upper may be helpful. The term "travel trajectory" may refer to the relative movement between the upper and ball. In one example, the ball may contact the upper first in a first contact portion and may move along the ball contact area toward a second contact portion, where the ball last contacts the upper. From the second contact portion, the ball may accelerate away from the upper. The first contact portion may be arranged closer to a sole rim. The second contact portion may be arranged closer to an instep portion. This movement of the ball may be more or less dominant, which can depend on the type of shot. For example, this movement may be more present, e.g., at curling shots, where the foot is "followed through" to create said ball spin. Such spin is also beneficial for straight shots, such as striking shots to a goal. In particular, while a shot without spin would be fluttering, the spin provides for the added benefit of keeping the ball on a substantially straight path to, e.g., a goal or the like. It is noted that there are many different types of shots, such as curled passes or flat passes. As described elsewhere herein in greater detail, directing the longitudinal axis of the protrusions substantially perpendicular to said travel trajectory offers an added benefit for assisting with shooting a ball.

Further, the spin of the ball has beneficial effects on its travel path by way of the Magnus effect. The Magnus effect may be understood as a phenomenon in fluid dynamics describing a force acting on a spinning (i.e., rotating) object, such as a ball, moving through a fluid, such as air. When a spinning ball moves through air, it may thereby experience a force perpendicular to the direction of its travel path. When a ball is kicked or thrown with spin, the air moving around the ball may be deflected in different directions due to the spin. Such deflection may create a difference in pressure between two opposing sides of the ball. This may result in a net force perpendicular to the direction of its travel path, i.e., of the airflow. As a result, the ball may deviate from a straight path. This may have advantages as a striking shot may be less predictable for a goalkeeper of an opposing team. In turn, this may increase the chances of scoring and/or achieving an anticipated outcome. Alternatively or additionally, it may allow to shoot around or above a free kick wall of an opposing team in soccer. The direction and magnitude of the Magnus force may depend on various factors, including but not being limited to the speed of the ball, the rate of spinning, the density of the air, and/or the roughness of the ball's surface.

The striking shots referred to herein require a different arrangement of protrusions on the upper so as to take into consideration the different travel trajectory of the ball (as compared to flat passes for instance). Said striking shots are typically shots that are stronger than other type of shots, such as mere passing shots. Although there may be variations from one player to another player, the skilled person is still able to distinguish between striking shots and other type of shots, such as passing shots. Striking shots often occur during a game, and the medial and top side of the first metatarsal joint and bone portions are mostly used for contacting the ball. In particular, the foot may be tilted laterally, and the ball upon impact may travel along the surface towards a lateral posterior direction.

The ball contact area may be understood as a region, portion, surface part or the like that can get in contact with a ball or the like. In particular, the ball contact area may be the area, which gets in contact with the ball during shooting. As understood, due to the deformation of a ball during shooting, the ball contact area could be larger than the area covered if the ball merely rests on the upper without shooting.

Each protrusion of the plurality of protrusions according to embodiments of the present disclosure has an elongated shape, which means that there may be a dimension along one axis of the shape, which may be larger than one and preferably than both dimensions along the remaining one axis preferably both axes that are substantially perpendicular to said one axis. Although not always explicitly expressed (e.g., by using the term "substantially"), it is understood that the parts, elements, units, shapes described herein comprise such manufacturing tolerances. Thus, the dimensions described herein may vary slightly.

The sole facing side portion and the instep facing side portion according to embodiments of the present disclosure may be understood as portions at two different sides of the protrusion. As an example, said portions may be on two opposing sides of a plane along the longitudinal axis. Moreover, the sole facing side portion and the instep facing side portion may extend substantially parallel to the longitudinal axis as described later. Further, said portions may alternatively or additionally be substantially perpendicular to the outer surface of the upper. In some embodiments of the present disclosure, the sole facing side portion may not be the side of the protrusion which faces the outer surface of the upper and/or which is in contact with the outer surface of the upper (e.g., at which the protrusion may be attached to the outer surface of the upper).

The sole facing side portion may be directed to a frontal portion of the upper, e.g., to a toe portion. For instance, when a ball touches the protrusion in a regular striking shot, the ball may first touch the sole facing side portion. This leads to bending of the protrusion. In turn, the sole facing side portion may be directed upwards at least partially when the protrusion is bent.

The instep facing side portion may be directed to the instep portion and/or more generally towards a rearward portion of the upper when the protrusion is not bent. When a ball touches the protrusion in a regular striking shot, the protrusion may be bent. In turn, the instep facing side portion may be directed downwards at least partially when the protrusion is bent. For instance, the instep facing side portion may be directed to the upper and/or to a sole of the shoe, when the protrusion is bent.

The sole facing side portion and the instep facing side portion may be free portions, e.g., portions that are free to the environment. To illustrate this in an example, sole facing side portion and the instep facing side portion could be touched or the like by a user.

Shooting may comprise any possible action in which the player arranges the shoe such that the upper gets in contact with the ball. As an example, shooting may comprise striking, dribbling, passing or the like. In some cases, shooting means that the player is striking, e.g., shooting with a rather fast foot movement to a goal.

Each of the plurality of protrusions may be elastically bendable. This means that the protrusions can bend, e.g., upon an external force, such as a force provided by a ball. Moreover, the bending is elastically, which means that the bending is performed substantially in an elastic deformation range of the protrusion's material. In such an elastic deformation range, the material's stress and strain may behave according to a linear relationship. This elastic (and linear) relationship for a material may also be known as Young's modulus. To the contrary, a plastic bending means that some of the deformation cannot be reverted.

Each protrusion is configured to bend substantially in a perpendicular direction to the longitudinal axis upon contact with the ball. In some embodiments, bending is performed to a greater or to a significant extent perpendicular to the longitudinal axis. It may still be possible that the protrusion is bending in a different direction. The term substantially may emphasize that for the determination of a perpendicular direction, manufacturing tolerances may be included.

Such bending in the perpendicular direction may be particularly useful, considering the travel trajectory of a ball during shooting. This allows that substantially at any portion of the upper along which the ball travels, a perpendicular bending is established, which may facilitate improved grip, increased contact area, and increased contact time is provided along the overall travel trajectory. Accordingly, the benefits of one protrusion may add up along the travel trajectory on the upper during shooting whenever a protrusion bends.

Each of the plurality of protrusions may be configured to bend such that the instep facing side portion touches an outer surface of the upper or an adjacent protrusion of the plurality of protrusions. The term "touches" may be understood such that the instep facing side portion at least partially contacts the outer surface of the upper or an adjacent protrusion of the plurality of protrusions. It may not be possible under all circumstances that all of the instep facing side can actually touch the outer surface of the upper or an adjacent protrusion of the plurality of protrusions. Rather, a portion thereof, i.e., the instep facing side portion (which could be a top part of the instep facing side) of the protrusion may typically touch said outer surface of the upper or an adjacent protrusion of the plurality of protrusions. In one example, the plurality of protrusions may be spaced distantly apart such that even if the protrusion was bent to a rather large extent, a contact with an adjacent protrusion is not possible.

The uppers described herein may be beneficial in conjunction with a sports shoe, such as a soccer shoe. However, it should be noted that the uppers could be used with any kind of article of footwear including, but not limited to football shoes, hiking boots, sneakers, basketball shoes, rugby shoes, baseball shoes, golf shoes, tennis shoes, cross-training shoes. Moreover, the uppers may be used in conjunction with shoes for any kind of athletic activity. The term athletic activity is to be understood such that it encompasses one or more and/or any combination of at least the following non-exhaustive list: aerobics, athletic exercises, running, hiking, climbing, group fitness classes, walking, cycling, yoga, soccer, tennis, football, basketball, doing a workout, volleyball, gymnastics, weightlifting, cross-training, baseball, softball, rugby, field hockey, wrestling, squash, track and field (such as sprinting, long jump, high jump), cross-country skiing.

It may be possible that the protrusions providing for the added benefits described herein are additionally or alternative used for garments, and/or equipment used in athletic activities. That is, the protrusions are not necessarily limited to the example of an upper for a shoe. The concept of the ball contact area can be transferred to any kind of athletic activity in which it can be desirable for a ball to be provided with spin, such as (table) tennis rackets or the like.

Nevertheless, the advantages of the protrusions described herein may be particularly pronounced when applied to an upper for a shoe, such as a shoe used during an athletic activity, particularly during soccer.

In some embodiments of the present disclosure, each protrusion of the plurality of protrusions may have a substantially triangular cross-section.

The cross-section may be understood as the cross-section along a plane, the normal of said plane being parallel to the longitudinal axis of the protrusion. In one example, the triangular cross-section of this embodiment could mean that a bottom portion of the protrusion is larger than a top portion. As an alternative, a top portion may be larger than a bottom portion.

This may have the advantage that the protrusions are supported to a greater extent. In addition, this cross-section can improve the bending, as the tip portion may be more flexible.

In some embodiments of the present disclosure, each protrusion of the plurality of protrusions may have a top edge and a bottom edge along the longitudinal axis of the protrusion being substantially parallel to each other.

The top edge may be understood as a free edge, i.e., as an edge that faces the environment. The bottom edge may be opposite to said top edge and may be attached to the upper, or integrally formed with the upper. This has the benefit that bending can be improved. For instance, when the ball hits the protrusion, the protrusion may easily bend around the bottom edge, which thereby forms a pivot axis.

It may be possible that each of the plurality of protrusions comprises additional edges in a top and/or bottom portion of the protrusion allowing for the creation of more advanced constructions and/or shapes. This could increase the variety of use cases of the upper, e.g., by providing certain portions of the upper with specifically shaped protrusions.

In some embodiments of the present disclosure, each protrusion of the plurality of protrusions may have a substantially quadrangular-shaped longitudinal section, such as a trapezoidal-shaped longitudinal section.

The longitudinal section may be understood as an intersection plane along the longitudinal axis of the elongate protrusion. In order words, the longitudinal section may be understood as a plane, the normal of said plane being perpendicular to the longitudinal axis of the elongate protrusion.

The quadrangular-shaped longitudinal section means that four corners may be recognizable. The quadrangular-shaped longitudinal section may further improve bending and support the beneficial effects associated with it (e.g., an increased ball contact area and an increased contact time). The trapezoidal-shaped longitudinal section may have the additional benefit that one edge may be shorter than an opposing edge. The shorter edge may be the top edge. This may have the advantage that no sharp corners are provided, which could adversely affect providing the ball with sufficient spin.

In some embodiments of the present disclosure, the longitudinal axis of the protrusion(s) may form an acute angle $\alpha$ with a heel to toe axis of the upper of at least 45°, at least 50°, at least 60°, at least 65°, at least 70°, at least 75°, at least 80°, or at least 85° in a toe portion of the upper; and/or at most 45°, at most 40°, at most 35°, at most 30°, at most 25°, at most 20°, or at most 15° in an upper medial midfoot portion of the upper.

In such embodiments, the acute angle of a protrusion in the toc portion of the upper may be larger compared to the acute angle of a protrusion in an upper medial midfoot portion of the upper. This may have the advantage that the orientation of the protrusion is adapted so as to take into account a travel trajectory of the ball. In particular, it may therefore be the case that during shooting, the ball travels substantially perpendicular with respect to the longitudinal axis of each of the protrusion. This may improve assisting with shooting the ball.

In particular, such an orientation with respect to a ball may lead to a greater deformation of the protrusions, this may increase the restoring force of the protrusions, which acts in the direction of a desired ball spin. In addition, the contact time may be increased. Also the contact area may be increased. The contact area and/or the amount of bending may increase with the force acting on the ball, e.g., the striking force.

As understood, acute angles measure less than 90 degrees.

The heel to toe axis of the upper corresponds to a straight line connecting the heel portion and the toc portion of the upper. As used herein and shown in for example, FIG. 2, the heel to toe axis of the upper is an axis extending length-wise along an upper and perpendicular both a toe-most point (a toe tip) on the upper and the heel-most point on the upper.

In some embodiments of the present disclosure, a first protrusion of the plurality of protrusions is arranged in a toe portion of the upper and a second protrusion may be arranged further rearward with respect to the first protrusion, wherein an acute angle of the first protrusion is greater than an acute angle of the second protrusion. In some embodiments, an acute angle of the first protrusion may be greater than an acute angle of the second protrusion by at least 10°, at least 15°, at least 20°, at least 25°, at least 30°, at least 35°, or at least 40°.

Respective advantages of this embodiment may be derivable from the foregoing embodiment. In particular, a greater deformation of the protrusions can be achieved. Moreover, the restoring force of the protrusions acts in an opposing direction of the travel trajectory of the ball. This can promote a desired ball spin.

In one example, the acute angle of the protrusions continuously decreases as the protrusions are arranged further rearward with respect to the first protrusion.

In some embodiments of the present disclosure each protrusion of the plurality of protrusions may have the shape of at least one of a ridge, a rip, a lamella or a fin.

Such shapes may be understood as projecting or extending structures. They may be thin and flat or the like. They may provide some functionality in terms of modifying fluid dynamics in their proximity and/or in enhancing stability. These shapes may be less disturbing when the upper is used during most of the time, e.g., without shooting. Accordingly, they may promote a natural feeling on the wearer's foot. Such shapes can be manufactured easily and promote assisting with shooting the ball.

In some embodiments of the present disclosure, at least two protrusions of the plurality of protrusions may differ in at least one of their shape, dimensions, and/or orientation.

Depending on the portion of the upper, a certain shape, dimension and/or orientation may be desired. It may also be possible that a different material is desired. As described elsewhere herein, the orientation may vary along the ball contact area. Moreover, the length of the protrusions may vary along the ball contact area. This may provide certain portions of the ball contact area with dedicated functions. The length of the protrusions may also depend on the number of protrusions that is in one area.

In some embodiments of the present disclosure, each protrusion of the plurality of protrusions may have a beveled edge on one, or on both ends, along the longitudinal axis of the protrusion.

A beveled edge may refer to an edge or surface that is angled or sloped, rather than being perpendicular or flush with an adjacent edge and/or an adjacent surface. A beveled edge may be characterized by a slanted or chamfered cut that creates an inclined plane along the edge.

This may have the advantage that sharp corners, and/or pointy portions of the protrusion are prevented. These could otherwise lead to an unwanted influence on the ball. As an example, when the upper is used for a pass or the like with a rather low movement velocity, the ball may be adversely affected when hit with such sharp corners, and/or pointy portions.

In addition, the beveled edge provides for reduced mechanical stresses. In particular, peaks of stresses often occur in proximity of sharp corners, and/or pointy portions.

The one or both ends may be understood as edges that form one or both opposing ends that may be free to the environment.

In some embodiments of the present disclosure, a travel trajectory may be defined on the upper, wherein the longitudinal axis of each protrusion is oriented substantially perpendicular to the travel trajectory.

The travel trajectory may comprise one or more travel directions, wherein a first travel direction is arranged in a toe portion of the upper and extends from the toe portion, in particular from a toe tip, towards an instep portion or an intermediate midfoot portion of the upper, wherein a second travel direction may be arranged in a medial portion of the upper and extends from a lower medial midfoot portion towards an instep portion or an intermediate midfoot portion of the upper. In some embodiments, one or more intermediate travel directions are arranged in between the first travel direction and the second travel direction and an orientation of the one or more intermediate travel directions varies between an orientation corresponding to the first travel direction and an orientation corresponding to the second travel direction. In some embodiments, the variation in one or more intermediate travel directions is continuous and/or monotonous from a toe portion of the upper to a medial portion of the upper.

This has the advantage that the protrusions bend substantially in the direction into which the travel trajectory is defined.

The travel trajectory may depend to some extent to a personal preference, on the type of shot, and/or on the strength of the shot.

As described elsewhere herein, this travel trajectory applies to ordinary striking shots, which are commonly performed during soccer. Furthermore, it may be possible that the travel trajectory of the ball is reversed for instance in case of so-called "top spin shots", as described elsewhere herein.

In some embodiments of the present disclosure, the plurality of protrusions protrudes from the outer surface of the upper.

This may be understood such that the protrusion distinctly extends from the outer surface of the upper. This means that in one example, the protrusion may not be understood as an element that is placed in a recessed portion of outer surface of the upper. Rather, the protrusion substantially starts from an outer surface of the upper and extends into the free environment. This may add to assisting with shooting a ball as described herein.

In some embodiments of the present disclosure, each protrusion of the plurality of protrusions has a height in a protruding direction of at least 0.5 mm, at least 1 mm, at least 1.5 mm, at least 2 mm, or at least 2.5 mm, and/or at most 5 mm, at most 4.5 mm, at most 4 mm, at most 3.5 mm, at most 3 mm, or at most 2.5 mm.

In some embodiments, the protrusion may not have an excessively large height, as this may adversely affect the natural feeling of the upper on a wearer's foot. In addition, this could lead to a rather high weight. The protrusions may additionally or alternatively not have a rather short height, as this may compromise the desired benefits in assisting with shooting the ball.

The protruding direction as described herein is the direction along which the protrusions extend from the outer surface of the upper. The protruding direction may be defined in a state when the protrusion is not bent. The protruding direction may be a direction that corresponds to a direction normal to the outer surface of the upper.

In some embodiments of the present disclosure, each protrusion of the plurality of protrusions has a width perpendicular to a protruding direction and to the longitudinal axis of the protrusion of at least 0.1 mm, or at least 0.2 mm, or at least 0.3 mm, or at least 0.4 mm, or at least 0.5 mm, or at least 0.6 mm; and/or at most 1.5 mm, or at most 1.25 mm, or at most 1.0 mm, or at most 0.9 mm, or at most 0.8 mm, or at most 0.7 mm, or at most 0.6 mm.

With the width specified in here, an optimal balance can be struck between sufficient bendability, savings in terms of material, and/or a natural feeling with less disturbance (low width would be desired) and sufficient support and/or mechanical integrity (large width would be desired).

In some embodiments, the width may vary along the height of the protrusion. For instance, the width at a bottom portion of the protrusion may be larger than the width of a top portion of the protrusion (or vice versa).

In some embodiments, the width at the bottom portion of the protrusion may be about 1 mm to 1.5 mm, or about 1.1 mm to 1.4 mm, or about 1.2 mm to 1.3 mm. At about halfway of the height of the protrusion, the width may be about 0.5 mm to 0.8 mm, or about 0.6 mm to 0.7 mm. The width at a top portion of the protrusion may be smaller compared to the width at about halfway of the height of the protrusion.

In some embodiments of the present disclosure, each protrusion of the plurality of protrusions has a length along the longitudinal axis of at least 2 mm, or at least 4 mm, or at least 6 mm, or at least 8 mm, or at least 10 mm, or at least 15 mm; and/or at most 40 mm, or at most 30 mm, or at most 25 mm, or at most 20 mm, or at most 15 mm.

Protrusions having a larger length facilitate that assisting with shooting the ball is improved. Protrusions having a shorter length have the advantage that stiffness of upper and/or a risk of breakage is reduced.

By way of the proposed lengths specified in here, an optimal balance can be struck between these opposing features.

In some embodiments of the present disclosure, the top edge of the protrusions has a length along the longitudinal axis of the protrusion of at most 100% of a length of the bottom edge along the longitudinal axis, or at most 90%, or at most 80%, or at most 70%, or at most 60%, or at most 50%, and/or of at least 50% of a length of the bottom edge along the longitudinal axis, or at least 60%, or at least 70%, or at least 80%, or at least 90%, or at least 100%.

The length of the top edge may be smaller compared to the bottom edge. In such embodiments, this can improve bending and promotes assisting with shooting the ball. However, the present disclosure also encompasses embodiments in which the top edge is larger compared to the bottom edge.

In some embodiments of the present disclosure, the distance between two adjacent protrusions is at least 0.5 times the height of one of the protrusions, or at least 0.75 times the height of one of the protrusions, or at least 1 time the height of one of the protrusions.

This has the advantage that there is sufficient space between two adjacent protrusions to allow one or both of them to bend as described herein.

The protrusion that serves as a reference in determining the distance may be the anterior protrusion. The anterior protrusion may be the protrusion that is arranged closer to a toe portion of the upper as seen along the heel to toe axis of the upper. It may alternatively be possible that the protrusion that serves as a reference in determining the distance is a rear protrusion, i.e., the protrusion on an opposing side of the anterior protrusion.

In some embodiments of the present disclosure, each protrusion of the plurality of protrusions is configured to bend by a bending angle of at least 5°, or at least 10°, or at least 15°, or at least 20°, or at least 25°, or at least 30°, or at least 35°, or at least 40°, or at least 45°.

This facilitates that each protrusion can be bent to a relatively large amount. This provides improved grip, and an increased contact time on the ball. As described herein, when a protrusion is bent, the instep facing side portion may be able to touch an outer surface of the upper or an adjacent protrusion of the plurality of protrusions. In this manner, increasing the bending angle supports such touching.

Prior art solutions are usually rather stiff and/or rigid, which do not allow for such bending. Such stiff and/or hard geometries cause a ball that gets in contact therewith during shooting to deform. This limits the creation of grip between the upper and the ball. Grip may then solely depend on the material. In addition, the prior art solutions reveal a rather harsh movement transition when the upper impacts the ball.

The bending angle may be understood as the acute angle of a line projecting from a base portion to a tip portion of each protrusion when bent, with respect to a line along the protruding direction of the protrusion when not bent.

In some embodiments of the present disclosure, each protrusion is spaced apart in a medial portion of the upper from a sole of the shoe by at least 5 mm, or at least 6 mm, or at least 7 mm, or at least 8 mm, or at least 10 mm, or at least 12 mm, or at least 16 mm, or at least 20 mm.

In such embodiments, a better placement of the protrusions for striking shots, compared to, e.g., curling shots can be achieved. In particular, striking shots may be characterized in that the ball may not contact such portion in proximity of the sole in the medial portion of the upper. Hence, it is advantageous that the protrusions are spaced apart therefrom to a sufficient extent and/or are not present in such a portion. In particular, finer ball control movements, such as dribbling or flat passes are not impaired thereby. Moreover, since the protrusions are placed at the desired places only, this reduces the amount thereof and the weight arising therefrom.

In some embodiments of the present disclosure, no protrusion is arranged in a lower medial portion of the upper in direct proximity of at least one of a sole of the shoe, a lateral portion of the upper, and/or a heel portion of the upper.

In such embodiments, this can facilitate a better placement of the protrusions for striking shots, compared to passing shots. As described elsewhere and particularly in the foregoing embodiment, it is beneficial that the protrusions are not present in such a portion. Thereby, finer ball control movements, such as dribbling or flat passes are not impaired, since such ball control movements typically entail that the lower medial portion of the upper in proximity of, e.g., the sole, predominantly contacts the ball. In addition, such embodiments reduce the amount of protrusions and the weight arising therefrom.

In some embodiments of the present disclosure, the ball contact area is arranged at least partially in at least one of a big toe portion, a big toe knuckle portion, a first metatarsal joint portion, a first metatarsal bone portion, an upper medial midfoot portion, and/or an intermediate midfoot portion. In one example, one or more of the plurality of protrusions is/are arranged at least partially in at least one of a big toe portion, a big toe knuckle portion, a first metatarsal joint portion, a first metatarsal bone portion, an upper medial midfoot portion, and/or an intermediate midfoot portion.

Such embodiments promote the ball contact area and/or the protrusions being arranged in strategically highly relevant portions of the upper. This may particularly be the case for striking shots.

The upper medial midfoot portion may include bones such as the cuneiform and navicular bones. The intermediate midfoot portion may be the dorsal portion, i.e., the portion between the medial and lateral portion. The ball contact area comprising the protrusions may be present in the intermediate midfoot portion when no laces are present. In some embodiments of the present disclosure, no protrusion is arranged in a lower medial midfoot portion of the upper. Additionally or alternatively, only flat or non-bendable protrusions are arranged in the lower medial midfoot portion of the upper.

Respective advantages of such embodiments may be derivable from the foregoing embodiments. Moreover, the flat or non-bendable protrusions may correspond to protrusions of a different type than the protrusions described elsewhere herein (which are bendable). In particular, the flat or non-bendable protrusions may be printed protrusions, or the like.

The term non-bendable may describe an object and/or material that is not easily bent, flexed, and/or deformed under ordinary conditions. The non-bendable protrusions may reveal a strong resistance to bending. The non-bendable protrusions may reveal an inability to be bent.

In some embodiments of the present disclosure, at least two protrusions from the plurality of protrusions are connected by a base element on the outer surface of the upper.

In such embodiments, the protrusions are provided with sufficient support, which additionally facilitates positioning of the protrusions and their attachment. The base element can be implemented by a stiffer material than the protrusions. Alternatively, the base element can be implemented by substantially the same or a similar material than the protrusions.

In some embodiments of the present disclosure, the base element passes substantially through a middle part of each protrusion.

The middle part of each protrusion may be understood as the middle with respect to its length along its longitudinal axis. In such embodiments, the protrusions may be held together at a portion which may be subject to the largest external forces during use. Thereby, the base element further supports that the protrusions are firmly attached. This can improve durability of the upper and its longevity. In turn, the upper may be more cost-effective.

In some embodiments, the base element may additionally encompass a larger portion of the protrusion on the outer surface of the upper. For example, it could encompass at least 20%, at least 50%, or at least 80% of a protrusion's length along its longitudinal axis. Nevertheless, in some embodiments, the base element may be rather thin with respect to its expansion along the outer surface of the upper. For example, the base element may encompass at most 30%, or at most 20% of the protrusion's length along its longitudinal axis.

In some embodiments of the present disclosure, the base element has a thickness of at most 1.5 mm, or at most 1 mm, or at most 0.8 mm; and/or at least 0.2 mm, or at least 0.4 mm, or at least 0.5 mm.

This has generally the advantage that a bulky and/or stiff feeling of the upper is avoided. Hence, a more natural feeling on the wearer's foot is provided.

The thickness that is too large, may adversely affect the natural feeling of the upper on a wearer's foot. In addition, a large thickness could lead to a rather large weight. Conversely, a thickness that is too small, may compromise the desired benefits in supporting the protrusions and providing a firm attachment.

By way of the proposed thicknesses specified in here, an optimal balance can be struck between these opposing features.

The thickness may be measured parallel to a protruding direction of the protrusions. In other words, the thickness may be measured parallel to a direction normal to the outer surface of the upper.

In some embodiments of the present disclosure, the at least two protrusions are integrally formed with the base element and are arranged in a first group of the ball contact area.

The at least two protrusions being integrally formed with the base element has the advantage that manufacturing thereof can be improved. Further, mechanical integrity can be enhanced, and, thereby, longevity of the upper can be improved. In particular, there may be less portions which are subject to stress peaks or the like. This may be due to the absence of any means for attachment, such as adhesives or the like.

In some embodiments of the present disclosure, the ball contact area comprises at least two further protrusions being integrally formed with a further base element and arranged in a second group. In some embodiments, the first group and the second group are spaced apart from each other by a distance greater than the distance between any two neighboring protrusions of the first group or the second group.

Similar advantages as mentioned in the foregoing embodiment also apply to such embodiments.

In addition, such embodiments can have the advantage that the ball contact area may be increased and/or that more protrusions are comprised by said ball contact area. Thereby a multitude of different designs can be established. For instance, the second group may be arranged at any desired portion of the upper, e.g., on the toe/vamp/instep area, which promotes that the desired properties in assisting with shooting the ball can be achieved.

In various examples, the first group and/or the second group comprises two, three, four, five or six protrusions, or the first group comprises six protrusions. When the second group is arranged further rearward as seen from the toe portion, the second group may comprise less protrusions compared to the first group. For instance, when the second group constitutes the most rearward group, said group may comprise no more than two or three protrusions.

In some embodiments of the present disclosure, the ball contact area comprises a recess arranged between the first group and the second group.

The recess may have the advantage that water and/or dirt can be guided therethrough, which improves that the portions of the upper that get in contact with a ball remain substantially dry and/or clean. Thereby, grip is improved, and a spin imparted to the ball is enhanced.

The recess may be particularly beneficial in wet weather conditions. In such conditions, the moisture could adversely affect friction as the water may stay on the outer surface of the upper.

The recess may be implemented in various ways including but not limited to a recess having the shape of a channel, a pipe or the like. The recess may be continuous. The recess may additionally or alternatively comprise sections with a varying depth, so as to provide a multitude of different constructions for improving properties of the upper in certain portions thereof.

In some embodiments of the present disclosure, the protrusions of the first group and/or the second group are arranged substantially parallel to one another along their longitudinal axis, wherein the protrusions of the first group and/or the second group may be spaced substantially equidistantly from one another.

In some embodiments of the present disclosure, each protrusion of the plurality of protrusions comprises a material including at least one of rubber, elastomer, casting polyurethane (CPU) and/or silicone.

Depending on the desired degree of bendability, a softer or harder material may be used. This allows to fine-tune the response of the upper to a ball. In addition, the choice of the material for the protrusions may depend on the remaining material of the upper, e.g., the underlying material of the upper. This may have an advantage with respect to attachment. In some embodiments comprising rubber and/or CPU, the material can be utilized fine-tune and to customize the grip and the assistance with shooting a ball.

Rubber comprises a high energy transfer, which is preferable in the ball contact area described herein. CPU and/or silicone materials may be employed in case a better bonding compared to rubber materials is desired. In particular, CPU and/or silicone materials are particularly suitable when bonding with textiles is to be performed.

Generally, the materials have the advantage of having a high energy transfer, which promotes that bending of the protrusions leads to a high restoring force. Hence, energy stored in the bent protrusions may be returned to the ball to provide for the desired spin.

The protrusions may be manufactured by any kind of manufacturing method including but not limited to overmoulding, additive manufacturing methods (e.g. 3D printing methods) and/or composite processing methods.

In some embodiments of the present disclosure, each protrusion of the plurality of protrusions comprises a material having a hardness in the range of 30-60 Shore A, or 35-55 Shore A, or 40-50 Shore A, or 40-45 Shore A.

A Shore A hardness within any of the ranges disclosed above can provide advantages in terms of bending of the protrusions and a respective restoring force once the protrusions are bent. This may give additional benefits in providing a desired spin to a ball.

Moreover, a Shore A hardness within any of the ranges disclosed above can ensure a smoother transition for striking shots (e.g., compared to rather hard geometries known in the prior art). This can be particularly advantageous for striking shots (e.g., compared to other shots like passing).

Shore hardness may be a measure of the resistance a material has to indentation. Different kind of shore hardness scales pertain for measuring the hardness of different materials, e.g., (soft rubbers, rigid plastics, and super soft gels, for example). Generally, the higher the number on the scale, the harder the material. A difference between the scales, e.g., Shore A and Shore D is that Shore A may be specified to measure flexible rubbers while Shore D may be specified for harder, rigid materials. The ranges may overlap at some levels, for instance at higher levels.

In some embodiments of the present disclosure, the upper further comprises a tongue configured to be folded so as to overlap, at least partially, laces of the upper.

The tongue has the advantage that it covers at least partially the laces of the upper. Accordingly, the tongue may improve the ball contact. In particular, the tongue may provide for a smooth surface for the ball. Thereby, impairment of ball contact by way of the laces can be reduced and/or substantially alleviated.

In some embodiments, the tongue may be arranged in an instep portion and/or an intermediate midfoot.

In some embodiments of the present disclosure, the ball contact area is a first ball contact area, and the tongue comprises a second ball contact area comprising a plurality of protrusions according to any one of the embodiments described herein.

This has the advantage that the beneficial properties provided by way of the plurality of protrusions is extended to a larger area of the upper. In particular, the portion of the foot at which the tongue is arranged may be a portion along which the ball travels during the travel trajectory. Hence, it was found that providing for a second ball contact area on said tongue improves the provision of the spin to the ball.

In some embodiments of the present disclosure, the second ball contact area is configured to substantially abut the first ball contact area when the tongue is folded.

This may be understood in such a manner that the second ball contact area continuously provides for an increased overall ball contact area without any gaps or the like in between. Thereby, a smooth and coherent overall ball contact area can be provided.

Abutting may be understood such that a border of the second ball contact area is in direct proximity to a border of the first ball contact area. In some embodiments, the first ball contact area and the second ball contact area are spaced distantly apart to some extent. This may depend on the exact position of the tongue and/or the extent to which the tongue is folded, as understood by the skilled person.

As an alternative to the upper comprising a tongue, the upper may be a lace-less upper. Such a lace-less upper bears the potential that the athlete saves time while putting on a shoe comprising such upper. Moreover, it becomes easier to clean the shoe. In addition, a lace-less upper avoids the possibility that the laces might tangle and result in accidents or injuries. Further, a lace-less upper also avoids the problem of a sudden unfastening of the laces during performing exercises, such as playing soccer.

In embodiments where the upper is a lace-less upper, the ball contact area be arranged at least partially in the intermediate midfoot portion, i.e., the portion in which laces are typically arranged for uppers with laces. This increases the ball contact area.

In some embodiments of the present disclosure, the sole facing side portion and the instep facing side portion of protrusions extend substantially parallel to the longitudinal axis of the protrusions.

This may have benefits in terms of manufacturing. In some embodiments, that the sole facing side portion and the instep facing side portion do not extend perfectly parallel to the longitudinal axis. For instance, as described elsewhere, the cross-section may have a triangular shape. In this regard, the term substantially may emphasize that for the parallel alignment, manufacturing tolerances may be included.

In some embodiments of the present disclosure, the sole facing side portion and the instep facing side portion are on opposing sides of a plane along the longitudinal axis substantially perpendicular to the outer surface of the upper.

In some embodiments of the present disclosure, one or more protrusions is/are arranged in a big toe portion, a big toe knuckle portion, an intermediate midfoot portion, and/or a lateral portion of the upper, each of the one or more protrusions being spaced apart by a first average distance. Further, one or more protrusions is/are arranged in an upper medial midfoot portion and/or a first metatarsal joint portion of the upper, each of the one or more protrusions being spaced apart by a second average distance. The first average distance may be greater than the second average distance.

The advantage of the described embodiment with different spacing of protrusions in various parts of the upper of a shoe lies in its ability to provide tailored structural support and comfort to the wearer's foot. This may include for instance a targeted support and flexibility. For instance, by arranging protrusions with different spacing in specific areas of the upper, the shoe can offer more support where it can be desirable, such as around the big toe and knuckle portions, while allowing greater flexibility in other areas like the medial midfoot or first metatarsal joint. This can help in accommodating natural foot movements and providing stability. In addition, the varying distances between protrusions can help the upper conform more closely to the unique shape of the wearer's foot, potentially enhancing the fit and reducing slippage inside the shoe.

In some embodiments of the present disclosure, one or more protrusions is/are arranged in a big toe portion, a big toe knuckle portion, an intermediate midfoot portion, and/or a lateral portion of the upper, each of the one or more protrusions having a first average density of protrusions. Further, one or more protrusions is/are arranged in an upper medial midfoot portion and/or a first metatarsal joint portion of the upper, each of the one or more protrusions having a first average density of protrusions. The first average density may be lower than the second average density.

Similar advantages as set forth above in the preceding embodiment may be applicable.

Further, embodiments of the present disclosure are directed to a shoe, for example a sports shoe, the shoe comprising: an upper according to any one of the embodiments described herein; and a sole attached to the upper.

It goes without saying that the technical properties shown or described for the upper, the advantages and the improvements over the state of the art are likewise applicable to the shoe, such as the sports shoe.

A first embodiment (1) of the present disclosure is directed to an upper (101, 201) for a shoe (100, 200, 300), such as a sports shoe, comprising: a ball contact area (150) comprising a plurality of protrusions (151); wherein each protrusion (151) of the plurality of protrusions (151) has an elongated shape with a longitudinal axis (LA), a sole (102, 202) facing side portion and an instep facing side portion; wherein the ball contact area (150) is configured to assist with shooting a ball (80) in that each protrusion (151) of the plurality of protrusions (151) is elastically bendable such that each protrusion (151) is configured to bend substantially in a perpendicular direction to the longitudinal axis (LA) upon contact with the ball (80), and such that each of the plurality of protrusions (151) is configured to bend such that the instep facing side portion (151*b*) touches an outer surface of the upper (101, 201) or an adjacent protrusion of the plurality of protrusions (151).

A second embodiment (2) of the present disclosure is directed to upper (101, 201) according to the first embodiment (1), wherein each protrusion (151) of the plurality of protrusions (151) has a substantially triangular cross-section.

A third embodiment (3) of the present disclosure is directed to the upper (101, 201) according to any one the first embodiment (1) or the second embodiment (2), wherein each protrusion (151) of the plurality of protrusions (151) has a top edge and a bottom edge along the longitudinal axis (LA) being substantially parallel to each other.

A fourth embodiment (4) of the present disclosure is directed to the upper (101, 201) according to any one of embodiments (1)-(3), wherein each protrusion (151) of the plurality of protrusions (151) has a substantially quadrangular-shaped longitudinal section, such as a trapezoidal-shaped longitudinal section.

A fifth embodiment (5) of the present disclosure is directed to upper (101, 201) according to any one of embodiments (1)-(4), wherein the longitudinal axis (LA) forms an acute angle (a) with a heel to toe axis (HT) of the upper (101, 201) of at least 45°, or at least 50°, or at least 65°, or at least 85° in a toe portion (105) of the upper (101, 201); and/or at most 45°, or at most 35°, or at most 25°, or at most 15° in an upper (101, 201) medial midfoot portion of the upper (101, 201).

A sixth embodiment (6) of the present disclosure is directed to the upper (101, 201) according to any one of embodiments (1)-(5), wherein a first protrusion of the plurality of protrusions (151) is arranged in a toe portion (105) of the upper (101, 201) and a second protrusion is arranged further rearward with respect to the first protrusion, and wherein an acute angle of the first protrusion is greater than an acute angle of the second protrusion by at least 10°, or at least 20°, or at least 30°, or at least 40°.

A seventh embodiment (7) of the present disclosure is directed to the upper (101, 201) according to any one of embodiments (1)-(6), wherein each protrusion (151) of the plurality of protrusions (151) has the shape of at least one of a ridge, a rip, a lamella or a fin.

An eighth embodiment (8) of the present disclosure is directed to upper (101, 201) according to any one of embodiments (1)-(7), wherein at least two protrusions (151) of the plurality of protrusions (151) differ in at least one of their shape, dimensions, and/or orientation.

A ninth embodiment (9) of the present disclosure is directed to the upper (101, 201) according to any one of embodiments (1)-(8), wherein each protrusion (151) of the plurality of protrusions (151) has a beveled edge on one, or on both ends, along the longitudinal axis (LA).

A tenth embodiment (10) of the present disclosure is directed to upper (101, 201) according to any one of embodiments (1)-(9), wherein a travel trajectory (TT) is defined on the upper (101, 201), wherein the longitudinal axis (LA) of each protrusion (151) is oriented substantially perpendicular to the travel trajectory (TT), wherein the travel trajectory (TT) comprises one or more travel directions (TD1, TDi, TD2) wherein a first travel direction (TD1) is arranged in a toe portion (105) of the upper (101, 201) and extends from the toe portion (105), in particular from a toe tip, towards an instep portion or an intermediate midfoot portion (120) of the upper (101, 201), wherein a second travel direction (TD2) is arranged in a medial portion (110) of the upper (101, 201) and extends from a lower medial mid-foot portion (111) towards an instep portion or an intermediate midfoot portion (120) of the upper (101, 201), wherein one or more intermediate travel directions (TDi) are arranged in between the first travel direction (TD1) and the second travel direction (TD2) and wherein an orientation of the one or more intermediate travel directions (TDi) varies between an orientation corresponding to the one of the first travel direction (TD1) and an orientation corresponding to the one of the second travel direction (TD2), wherein the variation may be continuous and/or monotonous from a toe portion (105) of the upper (101, 201) to a medial portion (110) of the upper (101, 201).

An eleventh embodiment (11) of the present disclosure is directed to the upper (101, 201) according to any one of embodiments (1)-(10), wherein the plurality of protrusions protrudes from the outer surface of the upper (101, 201).

A twelfth embodiment (12) of the present disclosure is directed to the upper (101, 201) according to any one of embodiments (1)-11), wherein each protrusion (151) of the plurality of protrusions (151) has a height in a protruding direction (PT) of at least 0.5 mm, or at least 1 mm, or at least 1.5 mm, or at least 2 mm, or at least 2.5 mm, and/or at most 5 mm, or at most 4.5 mm, or at most 4 mm, or at most 3.5 mm, or at most 3 mm, or at most 2.5 mm.

A thirteenth embodiment (13) of the present disclosure is directed to the upper (101, 201) according to any one of embodiments (1)-(12), wherein each protrusion (151) of the plurality of protrusions (151) has a width perpendicular to a protruding direction (PT) and to the longitudinal axis (LA) of at least 0.1 mm, or at least 0.2 mm, or at least 0.3 mm, or at least 0.4 mm, or at least 0.5 mm, or at least 0.6 mm; and/or at most 1.5 mm, or at most 1.25 mm, or at most 1.0 mm, or at most 0.9 mm, or at most 0.8 mm, or at most 0.7 mm, or at most 0.6 mm.

A fourteenth embodiment (14) of the present disclosure is directed to the upper (101, 201) according to any one of embodiments (1)-(13), wherein each protrusion (151) of the plurality of protrusions (151) has a length along the longitudinal axis (LA) of at least 2 mm, or at least 4 mm, or at least 6 mm, or at least 8 mm, or at least 10 mm, or at least 15 mm; and/or at most 40 mm, or at most 30 mm, or at most 25 mm, or at most 20 mm, or at most 15 mm.

A fifteenth embodiment (15) of the present disclosure is directed to the upper (101, 201) according to the third embodiment (3), wherein the top edge has a length along the longitudinal axis (LA) of at most 100% of a length of the bottom edge along the longitudinal axis (LA), or at most 90%, or at most 80%, or at most 70%, or at most 60%, or at most 50%, and/or at least 50% of a length of the bottom edge along the longitudinal axis (LA), or at least 60%, or at least 70%, or at least 80%, or at least 90%, or at least 100%.

A sixteenth embodiment (16) of the present disclosure is directed to upper (101, 201) according to any one of embodiments (1)-(15), wherein the distance between two adjacent protrusions (151) is at least 0.5 times the height of one of the protrusions (151), or at least 0.75 times the height of one of the protrusions (151), or at least 1 time the height of one of the protrusions (151).

A seventeenth embodiment (17) of the present disclosure is directed to the upper (101, 201) according to any one of embodiments (1)-(16), wherein each protrusion (151) of the plurality of protrusions (151) is configured to bend by a bending angle (B) of at least 5°, or at least 10°, or at least 15°, or at least 20°, or at least 25°, or at least 30°, or at least 35°, or at least 40°, or at least 45°.

An eighteenth embodiment (18) of the present disclosure is directed to the upper (101, 201) according to any one of embodiments (1)-(17), wherein each protrusion (151) is spaced apart in a medial portion (110) of the upper (101, 201) from a sole (102, 202) of the shoe (100, 200, 300) by at least 5 mm, or at least 8 mm, or at least 12 mm, or at least 16 mm, or at least 20 mm.

A nineteenth embodiment (19) of the present disclosure is directed to the upper (101, 201) according to any one of embodiments (1)-(18), wherein no protrusion (151) is arranged in a lower medial portion (111) of the upper (101, 201) in direct proximity of at least one of a sole (102, 202) of the shoe (100, 200, 300), a lateral portion (115) of the upper (101, 201), and/or a heel portion (125) of the upper (101, 201).

A twentieth embodiment (20) of the present disclosure is directed to the upper (101, 201) according to any one of embodiments (1)-(19), wherein the ball contact area (150) is arranged at least partially in at least one of a big toe portion, a big toe knuckle portion, a first metatarsal joint portion, a first metatarsal bone portion, an upper (101, 201) medial midfoot portion, and/or an intermediate midfoot portion (120).

A twenty-first embodiment (21) of the present disclosure is directed to the upper (101, 201) according to any one of embodiments (1)-(20), wherein no protrusion (151) is arranged in a lower medial midfoot portion of the upper (101, 201) or wherein flat or non-bendable protrusions (151) are arranged in the lower medial midfoot portion of the upper (101, 201).

A twenty-second embodiment (22) of the present disclosure is directed to the upper (101, 201) according to any one of embodiments (1)-(21), wherein at least two protrusions (151) from the plurality of protrusions (151) are connected by a base element (156) on the outer surface of the upper (101, 201).

A twenty-third embodiment (23) of the present disclosure is directed to the upper (101, 201) according to the twenty-second embodiment (22), wherein the base element (156) passes substantially through a middle part of each protrusion (151).

A twenty-fourth embodiment (24) of the present disclosure is directed to the upper (101, 201) according to the twenty-second embodiments (22) or the twenty-third embodiment (23), wherein the base element (156) has a thickness of at most 1.5 mm, or at most 1 mm, or at most 0.8 mm; and/or at least 0.2 mm, or at least 0.4 mm, or at least 0.5 mm.

A twenty-fifth embodiment (25) of the present disclosure is directed to the upper (101, 201) according to any one of embodiments (22)-(24), wherein the at least two protrusions (151) are integrally formed with the base element (156) and are arranged in a first group (160) of the ball contact area (150).

A twenty-sixth embodiment (26) of the present disclosure is directed to the upper (101, 201) according to the twenty-fifth embodiment (25), wherein the ball contact area (150) comprises at least two further protrusions (151) being integrally formed with a further base element and arranged in a second group (160'), wherein the first group (160) and the second group (160') are spaced apart greater than any two protrusions (151), which may be neighboring, of the first group (160) or the second group (160').

A twenty-seventh embodiment (27) of the present disclosure is directed to the upper (101, 201) according to the twenty-sixth embodiment (26), wherein the ball contact area (150) comprises a recess (155) arranged between the first group (160) and the second group (160').

A twenty-eighth embodiment (28) of the present disclosure is directed to the upper (101, 201) according to the twenty-sixth embodiment (26) or the twenty-seventh embodiment (27), wherein the protrusions (151) of the first group (160) and/or the second group (160') are arranged substantially parallel to one another along their longitudinal axis (LA), and wherein the protrusions (151) of the first group (160) and/or the second group (160') are spaced substantially equidistantly from one another.

A twenty-ninth embodiment (29) of the present disclosure is directed to the upper (101, 201) according to any one of embodiments (1)-(28), wherein each protrusion (151) of the plurality of protrusions (151) comprises a material including at least one of rubber, elastomer, casting polyurethane, and/or silicone.

A thirtieth embodiment (30) of the present disclosure is directed to the upper (101, 201) according to any one of embodiments (1)-(29), wherein each protrusion (151) of the plurality of protrusions (151) comprises a material having a hardness in the range of 30-60 Shore A, or 35-55 Shore A, or 40-50 Shore A, or 40-45 Shore A.

A thirty-first embodiment (31) of the present disclosure is directed to the upper (101, 201) according to any one of embodiments (1)-(30), wherein the upper (101, 201) further comprises a tongue configured to be folded so as to overlap at least partially the laces of the upper (101, 201).

A thirty-second embodiment (32) of the present disclosure is directed to the upper (101, 201) according to the thirty-first embodiment (31), wherein the ball contact area (150) is a first ball contact area and the tongue comprises a second ball contact area comprising a plurality of protrusions (151) according to any one of embodiments (1)-(31).

A thirty-third embodiment (33) of the present disclosure is directed to the upper (101, 201) according to the thirty-second embodiment (32), wherein the second ball contact area is configured to substantially abut the first ball contact area when the tongue is folded.

A thirty-fourth embodiment (34) of the present disclosure is directed to the upper (101, 201) according to any one of embodiments (1)-(33), wherein the sole (102, 202) facing side portion and the instep facing side portion (151*b*) extend substantially parallel to the longitudinal axis (LA).

A thirty-fifth embodiment (35) of the present disclosure is directed to the upper (101, 201) according to any one of embodiments (1)-(34), wherein the sole (102, 202) facing side portion and the instep facing side portion (151*b*) are on opposing sides of a plane along the longitudinal axis (LA) substantially perpendicular to the outer surface of the upper (101, 201).

A thirty-sixth embodiment (36) of the present disclosure is directed to the upper (101, 201) according to any one of embodiments (1)-(35), wherein one or more protrusions (151) is/are arranged in a big toe portion, a big toe knuckle portion, an intermediate midfoot portion, and/or a lateral portion (115) of the upper (101, 201), each of the one or more protrusions (151) being spaced apart by a first average distance, wherein one or more protrusions (151) is/are arranged in an upper medial midfoot portion and/or a first metatarsal joint portion of the upper (101, 201), each of the one or more protrusions (151) being spaced apart by a second average distance, and wherein the first average distance is greater than the second average distance.

A thirty-seventh embodiment (37) of the present disclosure is directed to the upper (101, 201) according to any one of embodiments (1)-(36), wherein one or more protrusions (151) is/are arranged in a big toe portion, a big toe knuckle portion, an intermediate midfoot portion, and/or a lateral portion (115) of the upper (101, 201), each of the one or more protrusions (151) having a first average density of protrusions (151), wherein one or more protrusions (151) is/are arranged in an upper medial midfoot portion and/or a first metatarsal joint portion of the upper (101, 201), each of the one or more protrusions (151) having a first average density of protrusions (151), and wherein the first average density is lower than the second average density.

A thirty-eighth embodiment (38) of the present disclosure is directed to a shoe, such as a sports shoe, comprising an upper according to any of embodiments (1)-(37) and a sole attached to the upper.

BRIEF DESCRIPTION OF THE FIGURES

The accompanying figures, which are incorporated herein, form part of the specification and illustrate embodiments of the present disclosure. Together with the description, the figures further serve to explain the principles of and to enable a person skilled in the relevant art(s) to make and use the disclosed embodiments. These figures are intended to be illustrative, not limiting. Although the disclosure is generally described in the context of these embodiments, it should be understood that it is not intended to limit the scope of the disclosure to these particular embodiments. In the drawings, like reference numbers indicate identical or functionally similar elements.

DETAILED DESCRIPTION

Figure 1:
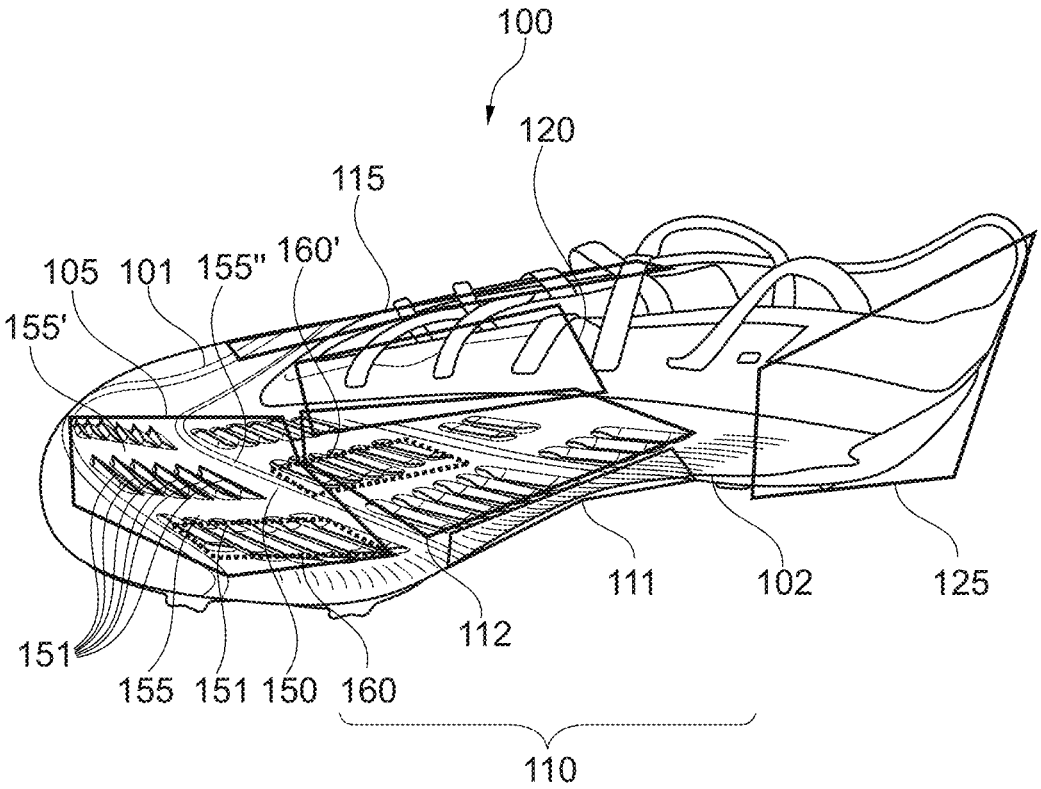
FIG. 1 shows an exemplary upper for a shoe, according to embodiments of the present disclosure.

Enhanced grip bears the potential that a player can control the ball to a greater extent. In particular, the contact of the shoe with the ball is of great importance, and the surface of the shoe upper plays an important role. One way to realize an increased grip between the upper and ball is to provide a texture on an exterior surface of the shoe upper. Another way to realize an increased grip is to provide the upper with protrusions. Both ways can increase the energy transfer from the upper to the ball during shooting.

For instance, there are curled passes, flat passes, striking shots or the like. For the different types of shots different arrangements on the upper of the shoe can be produce unique spin. Proper spin is desired for any kind of shot, because otherwise, the ball would be fluttering. Shoe uppers according to embodiments of the present disclosure provide enhanced grip to achieve various advantages described herein.

In the following possible embodiments of the disclosure are described in detail. However, the present disclosure is not limited to these, and a multitude of other embodiments are applicable without departing from the scope of the disclosure. The presented embodiments can be modified in a number of ways and combined with each other whenever compatible and certain features may be omitted in so far as they appear dispensable. In particular, the disclosed embodiments may be modified by combining certain features of one embodiment with one or more features of another embodiment.

It is to be understood that not all features of the described embodiments have to be present for realizing the technical advantages provided by the present disclosure. The disclosed embodiments may be modified by combining certain features of one embodiment with one or more features of another embodiment. Specifically, the skilled person will understand that features, and/or functional elements of one embodiment can be combined with technically compatible features, and/or functional elements of any other embodiment of the present disclosure given that the resulting combination falls within the definition of the present disclosure.

While the embodiments below are described primarily with reference to an upper for a shoe, such as a sports shoe, the skilled person will recognize that the disclosure according to the disclosure can equally be applied in a plurality of different technical fields and/or use cases.

Throughout the present figures and specification, the same reference numerals refer to the same elements. For the sake of clarity and conciseness, certain features, parts, elements, aspects, components and/or steps of certain embodiments are presented without undue detail where such detail would be apparent to those skilled person in the art in light of the teachings herein and/or where such detail would obfuscate an understanding of more pertinent aspects of the embodiments.

To avoid redundancies, reference is also made to the explanations in the preceding sections, which also apply to the following detailed description.

The "toe portion" as used herein may comprise portions in proximity of the big toe, and/or of the big toe knuckle.

The "upper medial midfoot portion" as used herein may comprise portions in proximity of the first metatarsal bone, and/or the medial midfoot bones such as the cuneiform and navicular bones.

Unless otherwise stated, the term "substantial" or "substantially" as used in the present context may be understood to a great or significant extent or for the most part or essentially. In particular, manufacturing tolerances are included by this term. Unless specified otherwise, when referring to a direction or dimension, the term "about," "substantial" or "substantially" means a first direction or dimension is +/−10% of a second direction or dimension.

The term "and/or" is only an association relationship describing associated objects and represents that three relationships may exist. For example, A and/or B may represent three conditions: i.e., independent existence of A, existence of both A and B, and independent existence of B. In addition, the character "/" in the disclosure usually represents that previous and next associated objects form an "or" relationship.

The terms "bottom", "top", "one end", "the other end", "outer side", "upper", "above", "inner side", "under", "below", "horizontal", "coaxial", "central", "end" "part", "length", "outer end" etc., which indicate the orientation or positional relationship, are based on the orientation or positional relationship shown in the drawings.

The terms "upper", "above", "below", "under" and the like as used in the present disclosure to indicate a relative position in space are used for the purpose of facilitating explanation to describe a garment, element, part, object and/or feature shown in the drawings relative to the relationship of another garment, element, part, object and/or feature.

The indefinite articles "a," "an," and "the" include plural referents unless clearly contradicted or the context clearly dictates otherwise.

The term "comprising" is an open-ended transitional phrase. A list of elements following the transitional phrase "comprising" is a non-exclusive list, such that elements in addition to those specifically recited in the list can also be present. The phrase "consisting essentially of" limits the composition of a component to the specified materials and those that do not materially affect the basic and novel characteristic(s) of the component. The phrase "consisting of" limits the composition of a component to the specified materials and excludes any material not specified.

Where a range of numerical values comprising upper and lower values is recited herein, unless otherwise stated in specific circumstances, the range is intended to include the endpoints thereof, and all integers and fractions within the range. It is not intended that the disclosure or claims be limited to the specific values recited when defining a range. Further, when an amount, concentration, or other value or parameter is given as a range, one or more ranges, or as list of upper values and lower values, this is to be understood as specifically disclosing all ranges formed from any pair of any upper range limit or value and any lower range limit or value, regardless of whether such pairs are separately disclosed.

Figure 2:
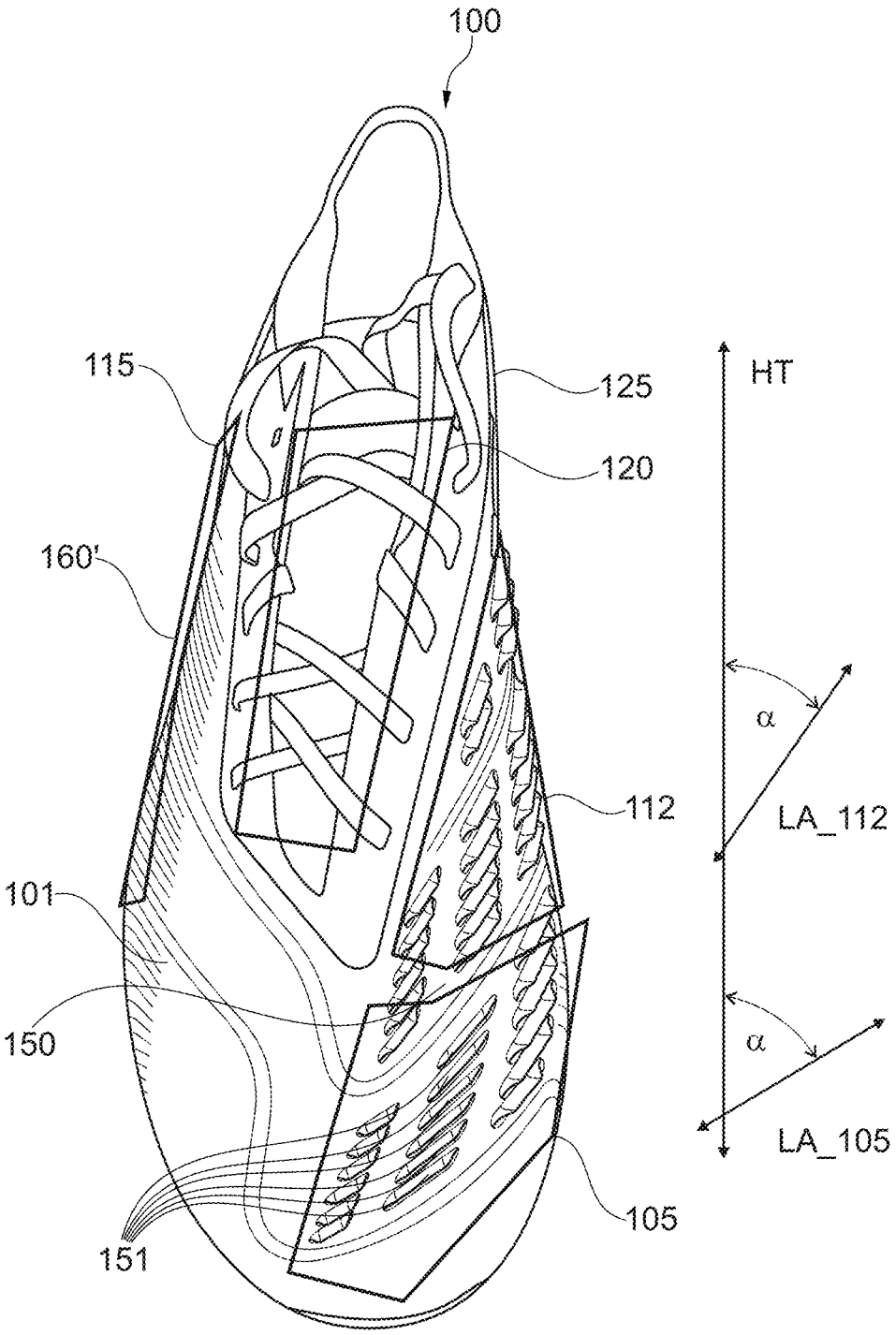
FIG. 2 shows the embodiment of FIG. 1 in a different perspective.
Figure 3:
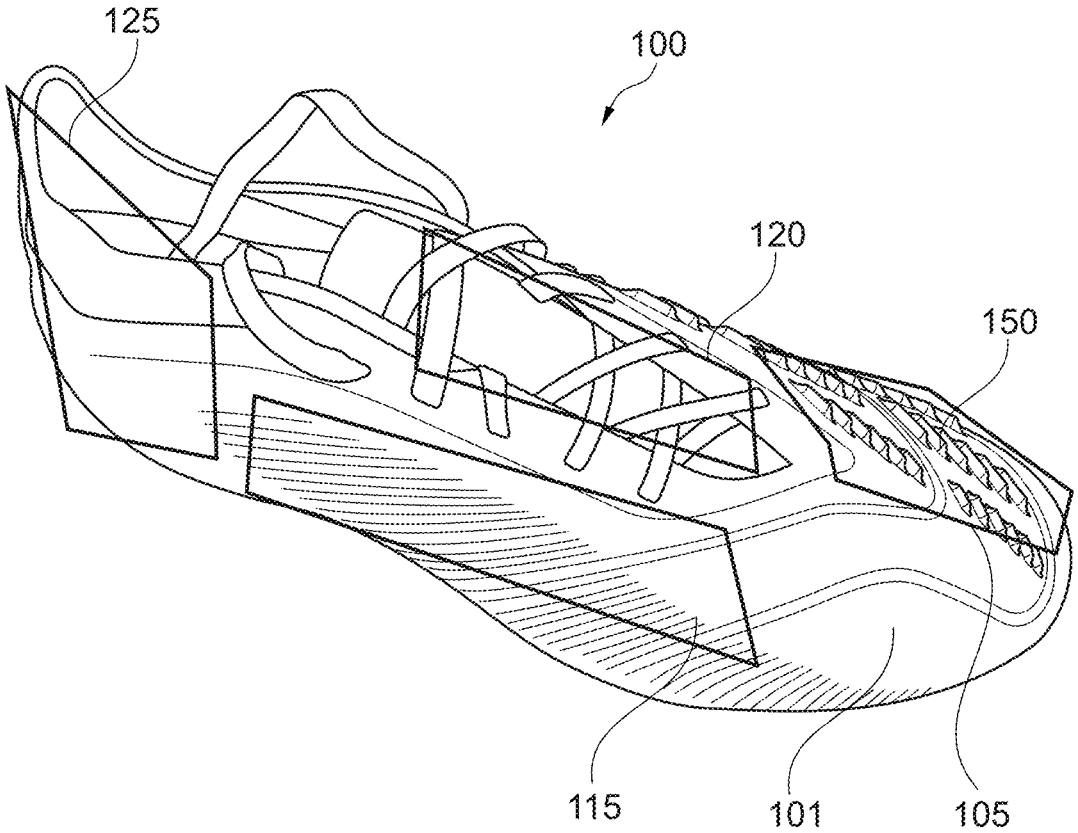
FIG. 3 shows the embodiment of FIG. 1 in a different perspective.

FIGS. 1 to 3 show an exemplary upper 101 for a shoe 100 according to an embodiment of the present disclosure in three different perspectives (FIG. 1, FIG. 2, FIG. 3).

The upper 101 comprises a ball contact area 150 comprising a plurality of protrusions 151. Each protrusion 151 of the plurality of protrusions 151 has an elongated shape with a longitudinal axis LA (as indicated in FIG. 2), a sole facing side portion 151*a* (as seen for example in FIG. 4) and an instep facing side portion 151*b* (as seen for example in FIG. 4). The ball contact area 150 is configured to assist with shooting a ball 80 (as seen for example in FIG. 4) in that each protrusion 151 of the plurality of protrusions 151 is elastically bendable such that each protrusion 151 is configured to bend substantially in a perpendicular direction to the longitudinal axis LA upon contact with the ball 80, and such that each protrusion 151 of the plurality of protrusions 151 is configured to bend such that the instep facing side portion 151*b* touches an outer surface of the upper 101 or an adjacent protrusion 151 of the plurality of protrusions 151.

As can be gathered from FIG. 1, each protrusion 151 of the plurality of protrusions 151 may have the shape of at least one of a ridge, a rip, a lamella or a fin. For instance, the protrusions 151 may have a major axis, such as a length, which is greater than a minor axis, such as a width. Moreover, each protrusion 151 of the plurality of protrusions 151 may have a beveled edge on one, or on both ends, along the longitudinal axis LA. The beveled edge may be formed by removing material from the edge at a specific angle and/or by cutting a sloping surface along the edge. The angle of the bevel may vary depending on the intended purpose and/or aesthetic considerations.

As shown in FIG. 2, a heel to toe axis HT is shown. Further, a longitudinal axis LA is indicated of an exemplary protrusion 151 of the plurality of protrusions 151 of a toe portion 105 (the respective longitudinal axis LA has the suffix 105). The longitudinal axis LA_105 forms an acute angle $\alpha$ with the heel to toe axis HT of the upper 101 of at least 45°, or at least 50°, or at least 65°, or at least 85° in a toe portion 105 of the upper. In addition, a longitudinal axis LA is indicated of an exemplary protrusion 151 of the plurality of protrusions 151 of an upper medial midfoot portion 112 of the upper 101 (the respective longitudinal axis LA has the suffix 112). The longitudinal axis LA_112 forms an acute angle $\alpha$ with the heel to toe axis HT of at most 45°, or at most 35°, or at most 25°, or at most 15° in an upper medial midfoot portion 112 of the upper 101.

Moreover, as an example shown in FIG. 2, a first protrusion 151 of the plurality of protrusions 151 is arranged in a toe portion 105 of the upper 101 and a second protrusion 151 is arranged further rearward with respect to the first protrusion 151 (e.g., in the upper medial midfoot portion 112). The acute angle $\alpha$ of the first protrusion 151 (in the toe portion 105) may be greater than the acute angle $\alpha$ of the second protrusion 151 (in the upper medial midfoot portion 112), for example greater by at least 10°, or at least 20°, or at least 30°, or at least 40°.

Further still, each protrusion 151 of the plurality of protrusions 151 may have a substantially quadrangular-shaped longitudinal section, such as a trapezoidal-shaped longitudinal section. The longitudinal section is a cross-section along the longitudinal axis LA of the elongate protrusion 151.

As can be further gathered from FIGS. 1 to 3, at least two protrusions 151 of the plurality of protrusions 151 may differ in at least one of their shape, dimensions, and/or orientation. Each protrusion 151 of the plurality of protrusions 151 may protrude from the outer surface of the upper 101. Hence, they may extend into the free environment.

The ball contact area 150 may be arranged at least partially in at least one of a big toe portion, a big toe knuckle portion, a first metatarsal joint portion, a first metatarsal bone portion, an upper medial midfoot portion 112, and/or an intermediate midfoot portion 120.

The ball contact area 150 may comprise one or more portions of the following: an intermediate and/or medial toe portion, a medial metatarsal portion (which could be near the sole 102), an intermediate and medial instep portion (which may be similar to the intermediate midfoot portion 120 as described elsewhere herein), and a front heel portion. The term intermediate may refer to the portions between lateral and medial. The term intermediate may be called dorsal.

Figure 4:
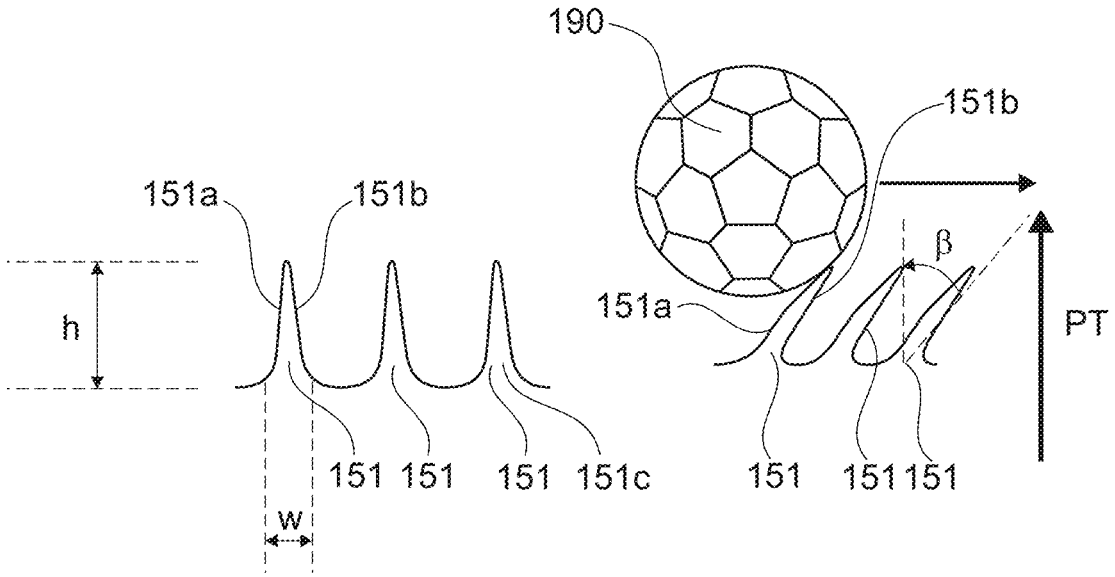
FIG. 4 shows a schematic figure of protrusions in an ordinary state and in a bent state, according to some embodiments of the present disclosure.

FIG. 4 shows a schematic figure of a plurality of protrusions 151 in an ordinary state and in a bent state, according to some embodiments.

Each protrusion 151 of the plurality of protrusions has an elongated shape with a longitudinal axis, which is directed into the image plane of FIG. 4. Further, each protrusion 151 has a sole facing side portion 151*a* (on one side of the longitudinal axis) and an instep facing side portion 151*b* (on the other side of the longitudinal axis). Each protrusion 151 of the plurality of protrusions 151 has a substantially triangular cross-section. The cross-section is along a plane, the normal of said plane being parallel to the longitudinal axis, i.e., directed into the image plane of FIG. 4. Moreover, each protrusion 151 of the plurality of protrusions 151 has a top edge at a top portion 151*d* and a bottom edge at a bottom portion 151*c*. Both edges are directed along the longitudinal axis, i.e., directed into the image plane of FIG. 4, and substantially parallel to each other. Attributable to the triangular cross-section, the bottom portion 151*c* may have two edges.

As indicated in this FIG. 4, each protrusion 151 of the plurality of protrusions 151 may be configured to bend by a bending angle β of at least 5°, or at least 10°, or at least 15°, or at least 20°, or at least 25°, or at least 30°, or at least 35°, or at least 40°, or at least 45°. As can be seen, by way of the bending angle, the sole facing side portion 151*a* may be directed upwards at least partially when the protrusion 151 is bent. Moreover, the instep facing side portion 151*b* may be directed to the upper and/or to a sole of the shoe 100 when the protrusion 151 is bent.

FIG. 4 also shows the height h in a protruding direction of each of the protrusion 151. As described elsewhere herein, the height may be at least 0.5 mm, or at least 1 mm, or at least 1.5 mm, or at least 2 mm, or at least 2.5 mm, and/or at most 5 mm, or at most 4.5 mm, or at most 4 mm, or at most 3.5 mm, or at most 3 mm, or at most 2.5 mm. Further, FIG. 4 shows the width w of each protrusion 151 of the plurality of protrusions 151, which is perpendicular to the protruding direction and to the longitudinal axis LA. As described elsewhere herein, the width w may be at least 0.1 mm, or at least 0.2 mm, or at least 0.3 mm, or at least 0.4 mm, or at least 0.5 mm, or at least 0.6 mm; and/or at most 1.5 mm, or at most 1.25 mm, or at most 1.0 mm, or at most 0.9 mm, or at most 0.8 mm, or at most 0.7 mm, or at most 0.6 mm. The length of each protrusion 151 of the plurality of protrusions 151 is measured along the longitudinal axis (as seen for example in FIG. 2, i.e., along the longitudinal axis LA_105 of the toe portion 105, or along the longitudinal axis LA_112 of the upper medial midfoot portion 112). In some embodiments, the protrusions 151 may have a maximum length, so that there may be no protrusions 151 extending continuously across the ball contact area 150. This has the advantage that recesses 155, 155', 155", such as channels, may be provided between protrusions 151, for instance along a medial to lateral or lateral to medial direction as described elsewhere herein.

A channel may have different cross-sectional shapes, such as rectangular, trapezoidal, circular, and/or irregular shapes and/or combinations thereof. The cross-sectional shape may depend on the channel's width, depth, and/or angles of its sides. The width of the channel may refer to the distance between its two substantially parallel sides. It may be measured perpendicular to the direction of flow, e.g., the flow of water (e.g., due to rain). The depth of a channel may refer to a vertical distance between a bottom of the channel and a top of the channel. It may be usually measured from the channel bed to a reference point. The channel may also be described by way of its slope or gradient. Such slope or gradient may describe the change in elevation along its length. It may represent a measure of how steeply the channel inclines or declines. Variations in the slope or gradient may be advantages in case the rain is to be guided rather quickly from one point of the upper to another one. Slope is typically expressed as a ratio or a percentage. One or more of the recesses 155, 155', 155" described herein may alternatively or additionally be implemented by way of passages, conduit, tubes, ducts, canal, corridor, groove, or the like.

Figure 5:
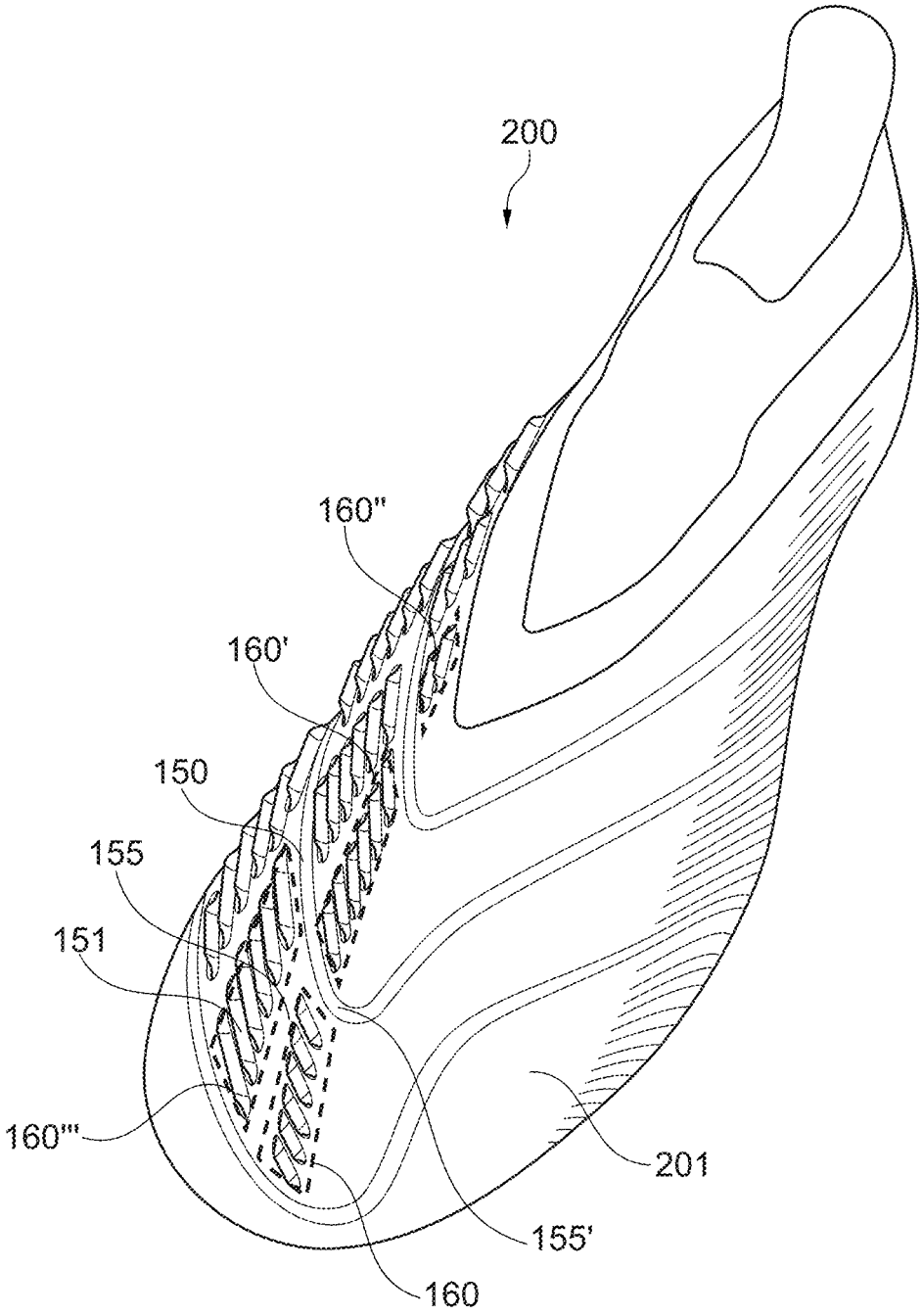
FIG. 5 shows an exemplary upper for a shoe, according to some embodiments of the present disclosure.
Figure 6:
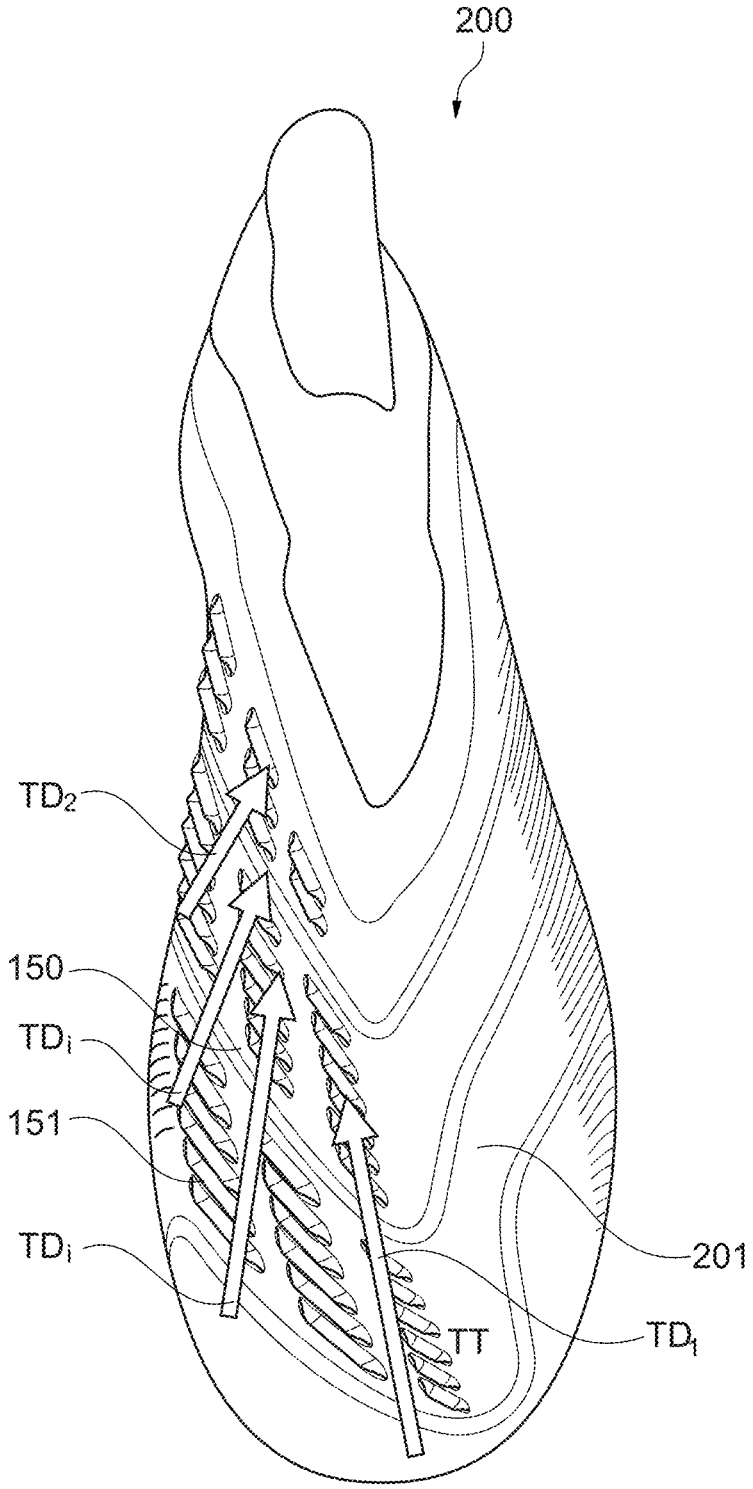
FIG. 6 shows the embodiment of FIG. 5 in a different perspective.
Figure 7:
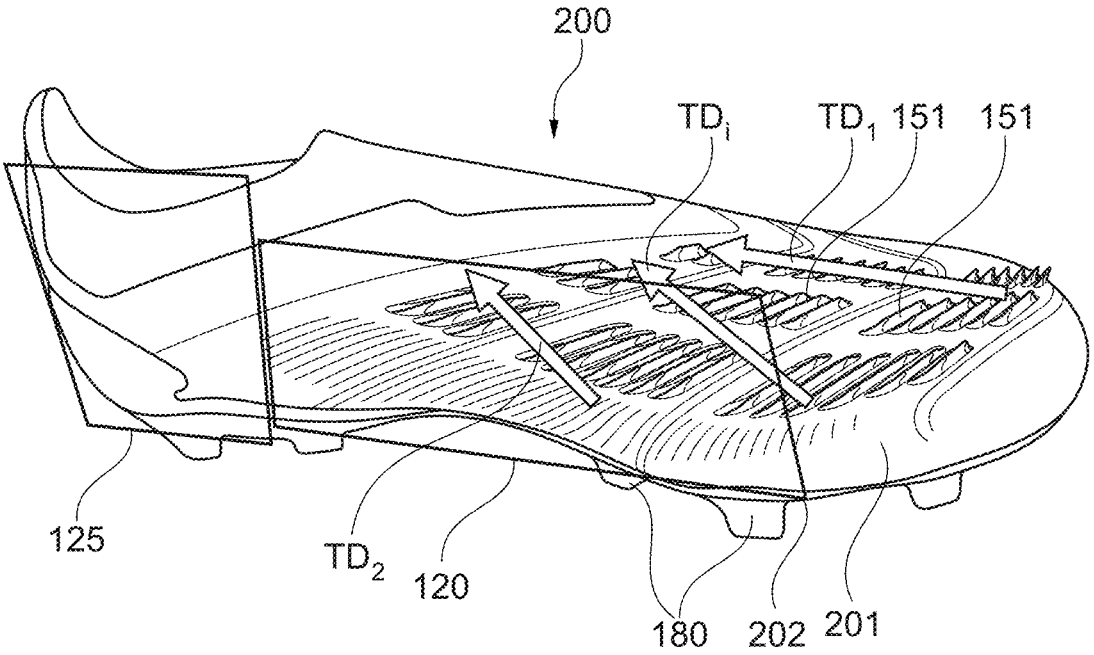
FIG. 7 shows the embodiment of FIG. 5 in a different perspective.

FIGS. 5 to 7 show an exemplary upper 201 for a shoe 200, according to some embodiments of the present disclosure in three different perspectives (FIG. 5, FIG. 6, and FIG. 7).

Upper 201 corresponds to the remaining embodiments described herein and mostly differences are highlighted but also common features are presented. The reference signs correspond to the remaining embodiments in here with an increase in the counter of hundreds by one, i.e., upper 201 corresponds to upper 101 of the remaining embodiments described herein.

Upper 201 is a lace-less upper 201, which can save time while putting on a shoe 200 comprising such upper 201. Such a lace-less upper 201 avoids the possibility that the laces might tangle and result in accidents or injuries.

In addition, a travel trajectory TT of the ball is indicated on upper 201, which is, however, also applicable to any other embodiment described herein and not limited to the one shown in FIGS. 5 to 7. Specific illustration of the travel trajectory TT is only left out in other figures for the sake of clarity.

The travel trajectory TT may comprise of one or more travel directions TD1, TDi, TD2 (as exemplarily indicated in FIGS. 6 and 7). A first travel direction TD1 is indicated, which is substantially arranged in the toe portion of the upper 201. The first travel direction TD1 may extend from the toe portion, in particular from the toe tip towards the instep portion of the upper 201. The second travel direction TD2 is substantially arranged in the medial portion 110 of the upper 201. The second travel direction TD2 may extend from the lower medial midfoot portion towards the instep portion of the upper 201. As can be further gathered from FIGS. 6 and 7, a plurality of intermediate travel directions TDi are indicated, which are arranged substantially in portions between the first travel direction TD1 and the second travel direction TD2. The intermediate travel directions TDi smoothly transition from an orientation substantially corresponding to the first travel direction TD1 to an orientation substantially corresponding to the second travel direction TD2. As understood, although in FIG. 6 two intermediate travel directions TDi are indicated and in FIG. 7 one intermediate travel direction TDi is indicated, a plurality thereof exist.

As mentioned herein, the travel trajectory TT may comprise one or more of the travel directions TD1, TDi, TD2. As an example, when the first contact portion is in a toe portion of the upper 201, the ball may travel along the travel direction TD1 at first and then along the travel direction TD2, ending in a second contact portion in proximity to the instep portion of the upper 201.

As understood, a plurality of exemplary travel trajectories TT can be present. For instance, a player may shoot the ball slightly differently compared to the foregoing example. For instance, the first contact portion may be in proximity to a Metatarsal bone. In such an example, that the travel direction TD1 indicated in FIGS. 6 and 7 may not be comprised by the travel trajectory TT, i.e., during this shot.

The travel trajectory TT comprises one or more of the depicted travel directions TD1, TDi, TD2. This may be explained, without wishing to be bound by theory, in that the ball may be deformed during a shot. Thereby, a rather large surface of the upper 201 may be in contact during ball impact, as described elsewhere herein.

The longitudinal axis LA of each protrusion 151 is oriented substantially perpendicular to the travel directions TD1, TDi, TD2 in the respective portions of the upper 201. As the travel trajectory TT comprises one or more of these travel directions TD1, TDi, TD2, the longitudinal axis LA of each protrusion 151 may also be oriented substantially perpendicular to the travel trajectory TT. The travel trajectory TT may be directed upwards and rearwards of the upper 201. It may start from multiple points along a rim of the sole 202 of the shoe 200. It may extend towards the intermediate midfoot portion 120.

Further to the foregoing analysis of the travel trajectory TT of the ball, it may be possible that the travel trajectory of the ball is reversed for instance in case of so-called "top spin shots". For such shots, the first ball contact portion may be rearward and/or towards the shoe opening. The second ball contact portion may be towards the toc portion 105. For such "top spin shots", a top spin is required and/or desired. During this type of shot, the foot hits the ball substantially in a center and moves through in an upward direction of the ball. As understood by the skilled person, the travel trajectory TT of the ball for these kind of shots may be opposite to the travel trajectory TT described elsewhere herein.

As understood, a plurality of protrusions 151 may be arranged on the upper 201 such that at least one of the protrusion 151 may be oriented substantially perpendicular to a respective type of shot, such as a curved shot, a straight shot, or the like.

As seen for example in FIG. 7 and applicable to all embodiments described herein, each protrusion 151 may be spaced apart in an intermediate midfoot portion 120 of the upper 201 from a sole 202 of the shoe 200 by at least 5 mm, or at least 8 mm, or at least 12 mm, or at least 16 mm, or at least 20 mm. Moreover, no protrusion 151 may be arranged in a lower medial portion 111 of the upper 201 in direct proximity of at least one of a sole 202 of the shoe 200, a lateral portion 115 of the upper (as seen for example in FIG. 3), and/or a heel portion 125 of the upper 201.

In particular, as exemplarily indicated in FIGS. 1 and 7, in some embodiments, either no protrusion 151 is arranged in a lower medial midfoot portion 111 of the upper 101 or flat or non-bendable protrusions may be arranged in the lower medial midfoot portion 111 of the upper 101. These flat or non-bendable protrusions may be manufactured in various ways including but not limited to 3D printing or the like.

As exemplarily indicated in FIG. 7, the shoe 100, 200 may be provided with studs 180, which may be also referred to as cleats. These may serve to provide traction for the player on a ground, in particular soft grounds such as grass fields or the like. The use of studs is known in the field of ball sports activities, such as soccer or football (e.g., American football), rugby or the like. In some examples, the studs can be integrally formed with the sole 202 of the shoe 200. The studs 180 may be at least partially injected onto a base material. In various examples, prefabricated stud tips may be placed in a mold and are over-injected with a base material. The base material may comprise portions of the sole 202. In various examples, the studs 180 may comprise TPU. Integrally formed or injected studs 180 have the advantage that no screws are needed and/or that the studs 180 do not need replacement. Nevertheless, it is also possible to apply interchangeable studs 180 or screw-on studs 180.

Figure 8:
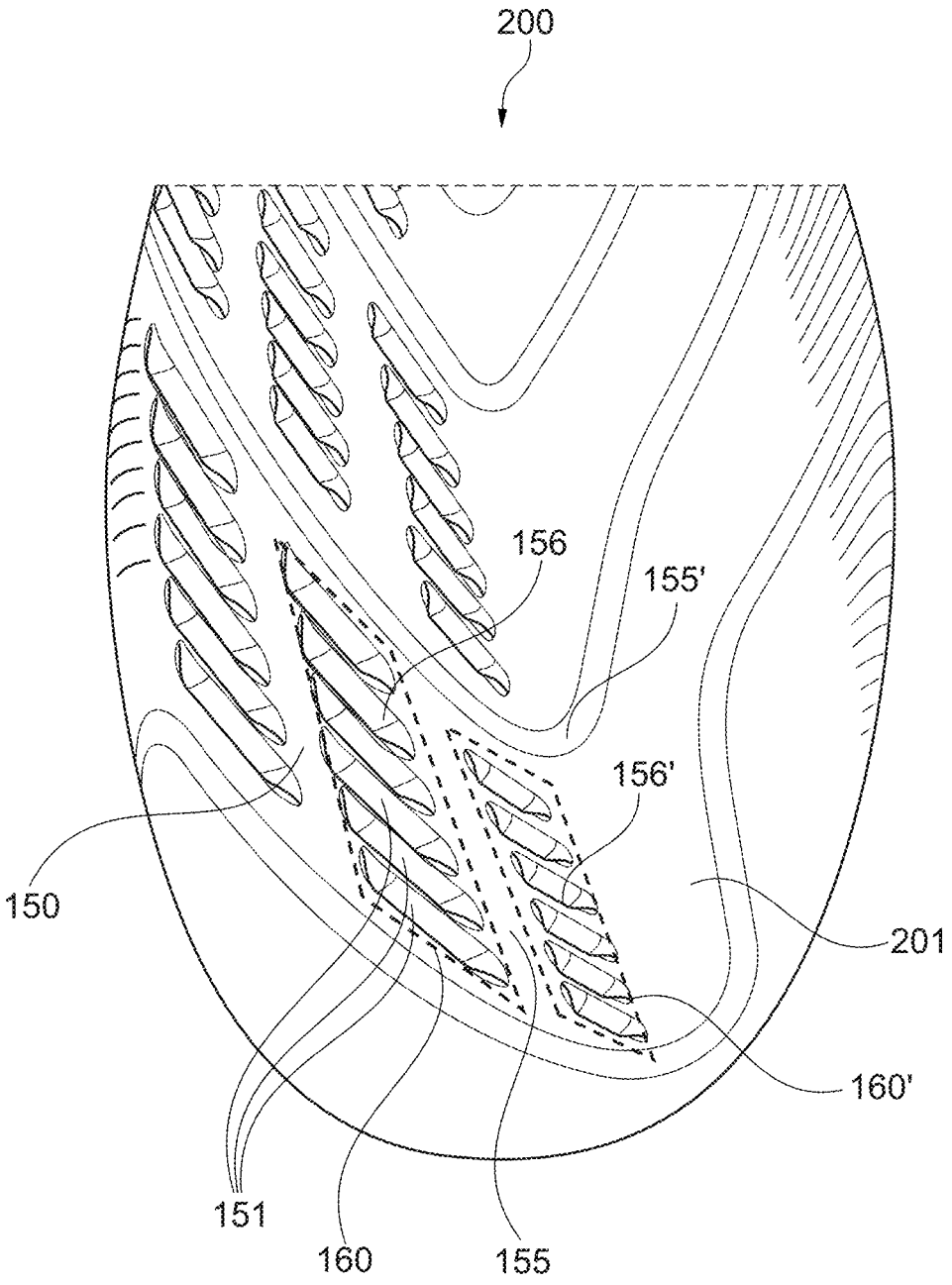
FIG. 8 shows a zoomed in view of a portion of FIG. 6.

FIG. 8 shows a part of FIG. 6 in a detailed perspective. As noted elsewhere herein, in some embodiments, at least two protrusions 251 from the plurality of protrusions 251 may be connected by a base element 156 on the outer surface of the upper 201. Said at least two protrusions 151 may be integrally formed with the base element 156. Said at least two protrusions 151 may be arranged in a first group 160 of the ball contact area 150. In this figure, six exemplary protrusions 151 are connected by the base element 156 and six protrusions 151 form one group 160, which is arranged in a toe portion 105 of the upper 201.

The base element 160 may have a thickness (in a protruding direction PT, as indicated in FIG. 4, of the protrusions 151) of at most 1.5 mm, or at most 1 mm, or at most 0.8 mm; and/or at least 0.2 mm, or at least 0.4 mm, or at least 0.5 mm.

In some embodiments, the first 156 and/or second 156' base element encompass an area on the upper 201 corresponding to the sum of each bottom portion's area of the protrusions 151 on said base element 156, 156'. The first 156 and/or second 156' base element may be greater by a factor of at least 1.05, or at least 1.1, or at least 1.15 than the sum of each bottom portion's area of the one or more protrusions 151 on said base element 156, 156'; and/or of at most 1.3, or at most 1.25, or at most 1.2, or at most 1.15 than the sum of each bottom portion's area of the one or more protrusions 151 on said base element 156, 156'.

In some embodiments, the contour of the base element(s) 156, 156' may correspond to the contour of the bottom portion of each of the protrusions 151 but being projected slightly outward. In some embodiments, there may be connections between each contour. In some embodiments, the space between each protrusion 151 of the same group 160, 160' may be covered by the base element(s) 156, 156' completely.

Moreover, as indicated in FIG. 8, the base element 160 may pass substantially through a middle part of each protrusion 151.

Further still, in some embodiments, the ball contact area 150 may comprise at least two further protrusions 151 being integrally formed with a further base element 156' and arranged in a second group 160'. The second group 160' may be arranged also in a toe portion 105 of the upper 201. However, as described elsewhere herein, the second group 160' may also be arranged further rearward (as indicated for example in FIG. 5). It can be seen that the first group 160 and the second group 160' are spaced apart greater than any two neighboring protrusions 151 of the first group 160 or the second group 160'. This allows the formation of recesses (e.g., channels) as described below, for allowing water and dirt to flow through.

Further, the ball contact area 150 comprises a recess 155 arranged between the first group 160 and the second group 160'. A further recess 155' is indicated in this figure, which is arranged in proximity to the first group 160 and/or the second group 160' towards a rearward end thereof. The recesses 155, 155' may adopt the shape of channels or the like as described elsewhere herein.

As can be gathered from FIG. 8, the protrusions 151 of the first group 160 and/or the second group 160' are arranged substantially parallel to one another along their longitudinal axis LA. Further, the protrusions 151 of the first group 160 and/or the second group 160' may be spaced substantially equidistantly from one another. Moreover, FIG. 8 shows that the distance between two adjacent protrusions 151 may be at least 0.5 times the height of one of the protrusions 151, such as the anterior protrusion 151, or at least 0.75 times the height of one of the protrusions 151, or at least 1 time the height of one of the protrusions 151.

The description of the base element(s) 156, 156', the first group 160 and/or the second group 160' may equally be applicable to any other embodiment described herein. Further, the number and arrangement of the groups 160, 160' is not limited to the example of FIG. 8. For instance, FIG. 5 indicates four groups 160, 160', 160", 160'", each of which may be provided with a respective base element. A first group 160 is arranged in a toe portion 105 having six protrusions 151. A second group 160' is arranged in portion encompassing a part of a toe portion 105 and a part of an upper medial midfoot portion 112 having six protrusions 151. A third group 160" is arranged in an upper medial midfoot portion 112 having two protrusions 151. A fourth group 160'" is again arranged in a toe portion 105 having six protrusions 151. Further, FIG. 5 indicates two recesses 155, in a similar way as FIG. 8.

As a further example of the arrangement of groups, FIG. 1 indicates two groups 160, 160', each of which may be provided with a respective base element. It is noted that the indication of the groups is not limited to these examples, the skilled person derives from, e.g., FIG. 1 that the upper 101 may comprise eight groups, three of which in a toc portion 105 and the remainder of which being in rearward portions with respect to the toe portion 105. Exemplarily, FIG. 1 indicates three recesses 155, 155', 155" arranged between the groups 160, 160'. In some embodiments, at least two protrusions 151 from the plurality of protrusions 151 may be connected by a base element 156 on the outer surface of the upper 101. Said at least two protrusions 151 may be integrally formed with the base element 156.

Figure 9:
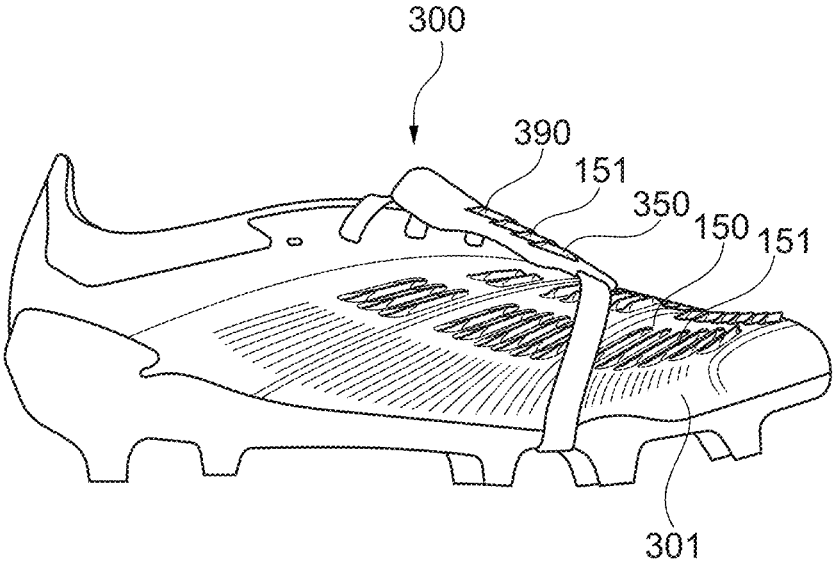
FIG. 9 shows an exemplary upper for a shoe, according to some embodiments of the present disclosure.
Figure 10:
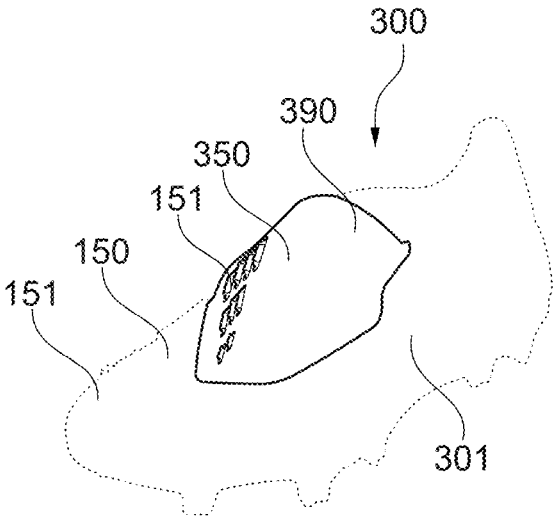
FIG. 10 shows a portion of FIG. 9 in a different perspective.

FIGS. 9 and 10 show an exemplary upper 301 for a shoe 300, according to some embodiments of the present disclosure.

Upper 301 corresponds to the remaining embodiments described herein and mostly differences are highlighted but also common features are presented.

Upper 301 comprises a tongue 390 configured to be folded so as to overlap at least partially laces of the upper 301.

The ball contact area 150 described elsewhere herein is a first ball contact area 150, and the tongue 390 comprises a second ball contact area 350 comprising a plurality of protrusions 151 according to any one of the embodiments described herein. As can be seen, the second ball contact area 350 may be configured to substantially abut the first ball contact area 150 when the tongue 390 is folded.

In some embodiments, one or more protrusions 151 may be arranged in a big toe portion, a big toe knuckle portion, an intermediate midfoot portion, and/or a lateral portion of the upper, each of the one or more protrusions 151 being spaced apart by a first average distance. Further, one or more protrusions 151 may be arranged in an upper medial midfoot portion and/or a first metatarsal joint portion of the upper, each of the one or more protrusions 151 being spaced apart by a second average distance. The first average distance may be greater than the second average distance.

This may have the advantage that the closer spacing of protrusions in certain areas may provide a cushioning effect, which can reduce pressure points and increase comfort during activities that involve a lot of foot movement or impact. In addition, the strategic placement of protrusions can reinforce high-stress areas of the shoe, potentially improving the durability and lifespan of the product. The arrangement of protrusions can also be designed to create a visually appealing pattern, which may enhance the marketability of the shoe. Depending on the design, the spacing between protrusions can also affect the breathability of the upper, with larger spaces allowing for more air circulation. By adjusting the spacing of protrusions, the design can influence how weight and pressure are distributed across the foot, which can be beneficial for reducing fatigue and improving the wearer's gait.

In some embodiments, one or more protrusions 151 may be arranged in a big toe portion, a big toe knuckle portion, an intermediate midfoot portion, and/or a lateral portion of the upper, each of the one or more protrusions 151 having a first average density of protrusions. Further, one or more protrusions 151 is/are arranged in an upper medial midfoot portion and/or a first metatarsal joint portion of the upper, each of the one or more protrusions 151 having a first average density of protrusions 151. The first average density may be lower than the second average density.

In any of the embodiments of the upper described herein, the instep facing side portion of each of the protrusions may encompass at least 20%, or at least 30%, or at least 40%, or at least 50%, or at least 60%, or at least 70%, or at least 80%, or at least 90% of the instep facing side of each of the protrusion. In other words, each of the plurality of protrusions may be configured to bend such that at least 20%, or at least 30%, or at least 40%, or at least 50%, or at least 60%, or at least 70%, or at least 80%, or at least 90% of the instep facing side of each of the protrusion touches the outer surface of the upper or an adjacent protrusion of the plurality of protrusions.

In any of the embodiments of the upper described herein, the first group may be arranged in a toe portion of the upper, wherein the longitudinal axis LA of the one or more protrusions of the first group is oriented substantially from a medial to a lateral portion of the upper, wherein the longitudinal axis LA forms an acute angle with a heel to toc axis of the upper of at least 45°, or at least 50°, or at least 55°, or at least 60°, or at least 65°, or at least 70°, or at least 75°, or at least 80°, or at least 85°.

In any of the embodiments of the upper described herein, the second group may be arranged in an upper medial midfoot portion, such as in proximity of the first metatarsal bone, and/or the medial midfoot bones such as the cuneiform and navicular bones, and/or in an intermediate midfoot portion, wherein the longitudinal axis of the one or more protrusions of the second group is oriented from a medial portion to a toe portion of the upper, wherein the longitudinal axis forms an acute angle with a heel to toe axis of the upper of at most 45°, or at most 40°, or at most 35°, or at most 30°, or at most 25°, or at most 20°, or at most 15° in an upper medial midfoot portion of the upper.

In any of the embodiments of the upper described herein, the protrusions 151 may be implemented by curved protrusions 151 and/or by altering the angle of adjacent protrusions 151, which may be substantially aligned along their longitudinal axis LA.

In any of the embodiments of the upper described herein, each protrusion 151 of the plurality of protrusions 151 comprises a material including at least one of rubber, elastomer, casting polyurethane, and/or silicone. Further, in all of the above embodiments, each protrusion 151 of the plurality of protrusions 151 may comprise a material having a hardness in the range of 30-60 Shore A, or 35-55 Shore A, or 40-50 Shore A, or 40-45 Shore A.

The upper and the lower limits of the ranges of the hardness values may be combined with one another.

In any of the embodiments of the upper described herein, mentioning of "first", "second" or the like merely corresponds to naming of elements, parts, groups or the like. This naming is not to be construed limiting but solely serves the purpose to illustrate the present disclosure.

It is noted that any one or more of the embodiments described herein and/or examples may be combined with further aspects as described herein and details of the embodiments and/or examples may also be omitted, as will be understood by the skilled person. The scope of protection is determined by the claims and is not limited by the embodiments and/or examples disclosed in the above figures.

For example, the following are exemplary embodiments for upper according to the present disclosure.

1a. An upper for a shoe, comprising: a. a ball contact area comprising at least one protrusion protruding from an outer surface of the upper; b, wherein the ball contact area is arranged at least partially in a toe portion of the upper; and c, wherein no protrusion protruding from the outer surface is arranged in a lower medial midfoot portion of the upper.

1b. An upper for a shoe, the upper comprising a. a ball contact area comprising at least two protrusions protruding from an outer surface of the upper; b, wherein the ball contact area is arranged at least partially in a toe portion of the upper; and c, wherein the at least two protrusions are connected by a base element on the outer surface of the upper.

1c. An upper for a shoe, the upper comprising a. a ball contact area comprising a plurality of protrusions; b, wherein a travel trajectory TT is defined on the upper and/or on the ball contact area, wherein the travel trajectory comprises one or more travel directions, wherein a first travel direction is arranged in a toe portion of the upper and extends from the toe portion, in particular from a toe tip, towards an instep portion or an intermediate midfoot portion of the upper, wherein a second travel direction is arranged in a medial portion of the upper and extends from a lower medial midfoot portion towards an instep portion or an intermediate midfoot portion of the upper, wherein one or more intermediate travel directions are arranged in between the first travel direction and the second travel direction and wherein an orientation of the one or more intermediate travel directions varies between an orientation corresponding to the one of the first travel direction and an orientation corresponding to the one of the second travel direction, wherein the variation is continuous and/or monotonous from a toe portion of the upper to a medial portion of the upper; and c, wherein a longitudinal axis of the one or more protrusions is oriented substantially perpendicular to the travel trajectory.

1d. An upper for a shoe, the upper comprising a. a ball contact area arranged at least in a toe portion of an outer surface of the upper, the ball area comprising one or more protrusions, projecting from the outer surface in a first direction; b, wherein the one or more protrusions each have an elongated shape with a longitudinal axis; c, wherein the one or more protrusions each have a top edge and a bottom edge along the longitudinal axis being substantial parallel to each other.

While various embodiments have been described herein, they have been presented by way of example, and not limitation. It should be apparent that adaptations and modifications are intended to be within the meaning and range of equivalents of the disclosed embodiments, based on the teaching and guidance presented herein. It therefore will be apparent to one skilled in the art that various changes in form and detail can be made to the embodiments disclosed herein without departing from the spirit and scope of the present disclosure. The elements of the embodiments presented herein are not necessarily mutually exclusive, but can be interchanged to meet various situations as would be appreciated by one of skill in the art.

Embodiments of the present disclosure are described in detail herein with reference to embodiments thereof as illustrated in the accompanying drawings, in which like reference numerals are used to indicate identical or functionally similar elements. References to "one embodiment," "an embodiment," "some embodiments," "in certain embodiments," etc., indicate that the embodiment described can include a particular feature, structure, or characteristic, but every embodiment can not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The examples are illustrative, but not limiting, of the present disclosure. Other suitable modifications and adaptations of the variety of conditions and parameters normally encountered in the field, and which would be apparent to those skilled in the art, are within the spirit and scope of the disclosure.

What is claimed is:

1. An upper for a shoe, comprising:

an outer surface comprising a recess and a ball contact area comprising a plurality of protrusions, wherein the recess extends from a lateral to a medial side of the outer surface and between a first and a second group of protrusions of the plurality of protrusions;

wherein each protrusion of the plurality of protrusions has an elongated shape with a longitudinal axis, a sole facing side portion, and an in-step facing side portion; and wherein each protrusion of the plurality of protrusions is configured to bend in a substantially perpendicular direction to the longitudinal axis upon contact with a ball, and wherein each protrusion of the plurality of protrusions is configured to bend such that the in-step facing side portion touches the outer surface of the upper or an adjacent protrusion of the plurality of protrusions.

2. The upper of claim 1, wherein each protrusion of the plurality of protrusions has a triangular cross-section.

3. The upper of claim 1, wherein each protrusion of the plurality of protrusions has a top edge and a bottom edge along the longitudinal axis being substantially parallel to each other.

4. The upper of claim 1, wherein each protrusion of the plurality of protrusions has a substantially quadrangular-shaped longitudinal section.

5. The upper of claim 1, wherein the longitudinal axis forms an acute angle with a heel to toe axis of the upper of at least 45° in a toe portion of the upper, or at most 45° in a medial midfoot portion of the upper.

6. The upper of claim 1, wherein a first protrusion of the plurality of protrusions is arranged in a toe portion of the upper and a second protrusion of the plurality of protrusions is arranged further rearward with respect to the first protrusion, and wherein an acute angle with a heel to toe axis of the upper of the first protrusion is greater than an acute angle with the heel to toe axis of the upper of the second protrusion.

7. The upper of claim 1, wherein each protrusion of the plurality of protrusions has a shape selected from the group consisting of: a ridge, a rip, a lamella, and a fin.

8. The upper of claim 1, wherein a travel trajectory is defined on the upper and is substantially perpendicular to the longitudinal axis of each protrusion, wherein a first travel direction of the travel trajectory is arranged in a toe portion of the upper and extends from the toe portion towards an instep portion or an intermediate midfoot portion of the upper, and wherein a second travel direction of the travel trajectory is arranged in a medial portion of the upper and extends from a lower medial midfoot portion towards an instep portion or an intermediate midfoot portion of the upper.

9. The upper of claim 1, wherein each protrusion of the plurality of protrusions has a height in a protruding direction of at least 0.5 mm and at most 5 mm.

10. The upper of claim 1, wherein each protrusion of the plurality of protrusions has a width perpendicular to a protruding direction and to the longitudinal axis of at least 0.1 mm and at most 1.5 mm.

11. The upper of claim 1, wherein each protrusion of the plurality of protrusions has a length along the longitudinal axis of at least 2 mm and at most 40 mm.

12. The upper of claim 1, wherein each protrusion is spaced apart in a medial portion of the upper from a sole of the shoe by at least 5 mm.

13. The upper of claim 1, wherein the ball contact area is arranged at least partially in at least one of a big toe portion, a big toe knuckle portion, a first metatarsal joint portion, a first metatarsal bone portion, an upper medial midfoot portion, or an intermediate midfoot portion of the upper.

14. The upper of claim 1, wherein at least two protrusions from the plurality of protrusions are connected by a base element on the outer surface of the upper.

15. The upper of claim 14, wherein the at least two protrusions are integrally formed with the base element.

16. The upper of claim 1, wherein each protrusion of the plurality of protrusions comprises a material composed of at least one of rubber, elastomer, casting polyurethane, or silicone.

17. The upper of claim 1, wherein each protrusion of the plurality of protrusions comprises a material having a hardness in the range of 30-60 Shore A.

18. The upper of claim 1, wherein the sole facing side portion and the instep facing side portion are on opposing sides of a plane along the longitudinal axis substantially perpendicular to the outer surface of the upper.

19. A shoe, comprising:

an upper according to claim 1; and a sole attached to the upper.

20. An upper for a shoe, comprising:

an outer surface defining lateral and medial sides of the upper, the outer surface having a ball contact area comprising a plurality of protrusions, wherein the plurality of protrusions is integrally formed with the outer surface of the upper;

wherein each protrusion of the plurality of protrusions has an elongate shape with a longitudinal axis, a sole facing side portion, and an in-step facing side portion; and wherein each protrusion of the plurality of protrusions is configured to bend in a substantially perpendicular direction to the longitudinal axis upon contact with a ball, and wherein each protrusion of the plurality of protrusions is configured to bend such that the in-step facing side portion touches the outer surface of the upper or an adjacent protrusion of the plurality of protrusions.

21. The upper of claim 20, wherein a plurality of recesses are formed within the outer surface, wherein at least one recess of the plurality of recesses extends from a lateral to a medial side of the outer surface.

22. An upper for a shoe, comprising:

an outer surface comprising a ball contact area comprising a plurality of fins;

wherein each fin of the plurality of fins has an elongated shape with a longitudinal axis, a sole facing side portion, and an in-step facing side portion;

wherein each fin of the plurality of fins is configured to bend in a substantially perpendicular direction to the longitudinal axis upon contact with a ball, and wherein each fin of the plurality of fins is configured to bend such that the in-step facing side portion touches the outer surface of the upper or an adjacent fin of the plurality of fins; and wherein each fin of the plurality of fins has a height in a protruding direction of at least 0.5 mm and at most 5 mm, a width perpendicular to the protruding direction and to the longitudinal axis of at least 0.1 mm and at most 1.5 mm, and a length along the longitudinal axis of at least 2 mm and at most 40 mm.

* * * * *